US009150344B2

(12) United States Patent
Euler et al.

(10) Patent No.: US 9,150,344 B2
(45) Date of Patent: Oct. 6, 2015

(54) BLANK FOR CONTAINER

(71) Applicant: Berry Plastics Corporation, Evansville, IN (US)

(72) Inventors: John B Euler, Evansville, IN (US); Jason J Paladino, Newburgh, IN (US); Chris K Leser, Evansville, IN (US)

(73) Assignee: BERRY PLASTICS CORPORATION, Evansville, IN (US)

( * ) Notice: Subject to any disclaimer, the term of this patent is extended or adjusted under 35 U.S.C. 154(b) by 0 days.

(21) Appl. No.: 14/106,114

(22) Filed: Dec. 13, 2013

(65) Prior Publication Data

US 2014/0166738 A1 Jun. 19, 2014

Related U.S. Application Data

(60) Provisional application No. 61/737,406, filed on Dec. 14, 2012.

(51) Int. Cl.

| | |
|---|---|
| ***B65D 81/38*** | (2006.01) |
| ***B65D 5/66*** | (2006.01) |
| ***B65D 5/20*** | (2006.01) |

(52) U.S. Cl.

CPC ..... *B65D 81/3848* (2013.01); *B65D 5/2052* (2013.01); *B65D 5/6661* (2013.01); *B65D 81/3865* (2013.01)

(58) Field of Classification Search

USPC ..... 229/403; 220/738; 493/158

See application file for complete search history.

(56) References Cited

U.S. PATENT DOCUMENTS

| | | | | |
|---|---|---|---|---|
| 1,396,282 | A | | 11/1921 | Penn |
| 1,435,120 | A | * | 11/1922 | Holman ..... 229/400 |
| 1,920,529 | A | | 8/1933 | Sidebotham |
| 1,969,030 | A | | 8/1934 | Page |
| 2,097,899 | A | | 11/1937 | Smith |
| 2,809,776 | A | | 10/1957 | Barrington |
| 3,312,383 | A | | 4/1967 | Shapiro |
| 3,327,038 | A | | 6/1967 | Fox |
| 3,344,222 | A | | 9/1967 | Shapiro |
| 3,468,467 | A | | 9/1969 | Amberg |
| 3,547,012 | A | | 12/1970 | Amberg |
| 3,583,624 | A | | 6/1971 | Peacock |
| 3,733,381 | A | | 5/1973 | Willette |
| 3,793,283 | A | | 2/1974 | Frailey |
| 3,846,349 | A | | 11/1974 | Harada |
| 3,967,991 | A | | 7/1976 | Shimano |
| 3,971,696 | A | | 7/1976 | Manfredi |
| 4,049,122 | A | | 9/1977 | Maxwell |

(Continued)

FOREIGN PATENT DOCUMENTS

| | | |
|---|---|---|
| CA | 2291607 | 6/2000 |
| CA | 2765489 | 12/2010 |

(Continued)

OTHER PUBLICATIONS

New Zealand First Examination Report for Application No. 621219 dated Nov. 17, 2014.

(Continued)

*Primary Examiner* — Christopher Demeree

(74) *Attorney, Agent, or Firm* — Barnes & Thornburg LLP

(57) ABSTRACT

A blank made of a polymeric material is provided and used to form the body of a drink cup or other container. A floor can be coupled to the body to define an interior region of the cup.

16 Claims, 14 Drawing Sheets

(56) References Cited

U.S. PATENT DOCUMENTS 4,070,513 A 1/1978 Rhoads
4,106,397 A 8/1978 Amberg
4,171,085 A 10/1979 Doty
4,197,948 A 4/1980 Amberg
4,240,568 A 12/1980 Pool
4,284,226 A 8/1981 Herbst
4,298,331 A 11/1981 Mueller
4,299,349 A 11/1981 Gilden
4,300,891 A 11/1981 Bemiss
4,349,400 A 9/1982 Gilden
4,365,460 A 12/1982 Cress
4,409,045 A 10/1983 Busse
4,550,046 A 10/1985 Miller
4,621,763 A * 11/1986 Brauner ..... 229/5.5
4,706,873 A 11/1987 Schulz
4,720,023 A 1/1988 Jeff
4,878,970 A 11/1989 Schubert
4,918,112 A 4/1990 Roox
4,940,736 A 7/1990 Alteepping
5,078,817 A 1/1992 Takagaki
5,158,986 A 10/1992 Cha
5,160,674 A 11/1992 Colton
5,180,751 A 1/1993 Park
5,286,428 A 2/1994 Hayashi
5,308,568 A 5/1994 Lipp
5,348,795 A 9/1994 Park
5,366,791 A 11/1994 Carr
5,385,260 A 1/1995 Gatcomb
5,443,769 A 8/1995 Karabedian
5,445,315 A 8/1995 Shelby
5,490,631 A 2/1996 Iioka
5,547,124 A 8/1996 Mueller
5,605,936 A 2/1997 DeNicola, Jr.
5,622,308 A 4/1997 Ito
5,628,453 A 5/1997 MacLaughlin
5,629,076 A 5/1997 Fukasawa
5,759,624 A 6/1998 Neale
5,765,710 A 6/1998 Bergerioux
5,766,709 A 6/1998 Geddes
5,769,311 A 6/1998 Morita
5,819,507 A 10/1998 Kaneko
5,840,139 A 11/1998 Geddes
5,866,053 A 2/1999 Park
5,868,309 A 2/1999 Sandstrom
5,944,225 A 8/1999 Kawolics
5,948,839 A 9/1999 Chatterjee
6,007,437 A 12/1999 Schickert
6,030,476 A 2/2000 Geddes
6,034,144 A 3/2000 Shioya
6,051,174 A 4/2000 Park
6,071,580 A 6/2000 Bland
6,103,153 A 8/2000 Park
6,129,653 A 10/2000 Fredricks
6,136,396 A 10/2000 Gilmer
6,139,665 A 10/2000 Schmelzer
6,142,331 A 11/2000 Breining
6,169,122 B1 1/2001 Blizard
6,231,942 B1 5/2001 Blizard
6,235,380 B1 5/2001 Tupil
6,267,837 B1 7/2001 Mitchell
6,284,810 B1 9/2001 Burnham
6,294,115 B1 9/2001 Blizard
6,306,973 B1 10/2001 Takaoka
6,308,883 B1 10/2001 Schmelzer
6,319,590 B1 11/2001 Geddes
6,328,916 B1 12/2001 Nishikawa
6,376,059 B1 4/2002 Anderson
6,379,802 B2 4/2002 Ito
6,420,024 B1 7/2002 Perez
6,444,073 B1 9/2002 Reeves
6,468,451 B1 10/2002 Perez
6,472,473 B1 10/2002 Ansems
RE37,932 E 12/2002 Baldwin
6,512,019 B1 1/2003 Agarwal
6,521,675 B1 2/2003 Wu
6,541,105 B1 4/2003 Park
6,562,447 B2 5/2003 Wu
6,565,934 B1 5/2003 Fredricks
6,586,532 B1 7/2003 Gauthy
6,593,005 B2 7/2003 Tau
6,593,384 B2 7/2003 Anderson
6,613,811 B1 9/2003 Pallaver
6,616,434 B1 9/2003 Burnham
6,646,019 B2 11/2003 Perez
6,649,666 B1 11/2003 Read
6,713,139 B2 3/2004 Usui
6,720,362 B1 4/2004 Park
6,749,913 B2 6/2004 Watanabe
6,779,662 B2 8/2004 Dorsey
6,811,843 B2 11/2004 DeBraal
6,814,253 B2 11/2004 Wong
6,883,677 B2 4/2005 Goeking
6,884,377 B1 4/2005 Burnham
6,884,851 B2 4/2005 Gauthy
6,908,651 B2 6/2005 Watanabe
6,926,507 B2 8/2005 Cardona
6,926,512 B2 8/2005 Wu
7,070,852 B1 7/2006 Reiners
7,074,466 B2 7/2006 DeBraal
7,094,463 B2 8/2006 Haas
7,121,991 B2 * 10/2006 Mannlein et al. ..... 493/109
7,144,532 B2 12/2006 Kim
7,173,069 B2 2/2007 Swennen
7,234,629 B2 6/2007 Ho
7,281,650 B1 10/2007 Milan
7,355,089 B2 4/2008 Chang
7,361,720 B2 4/2008 Pierini
7,365,136 B2 4/2008 Huovinen
7,423,071 B2 9/2008 Mogami
7,458,504 B2 12/2008 Robertson
7,504,347 B2 3/2009 Poon
7,510,098 B2 3/2009 Hartjes
7,513,386 B2 4/2009 Hartjes
7,514,517 B2 4/2009 Hoenig
7,524,911 B2 4/2009 Karjala
7,557,147 B2 7/2009 Martinez
7,579,408 B2 8/2009 Walton
7,582,716 B2 9/2009 Liang
7,585,557 B2 9/2009 Aylward
7,592,397 B2 9/2009 Markovich
7,608,668 B2 10/2009 Shan
7,622,179 B2 11/2009 Patel
7,622,529 B2 11/2009 Walton
7,629,416 B2 12/2009 Li
7,655,296 B2 2/2010 Haas
7,662,881 B2 2/2010 Walton
7,666,918 B2 2/2010 Prieto
7,671,106 B2 3/2010 Markovich
7,671,131 B2 3/2010 Hughes
7,673,564 B2 3/2010 Wolf
7,687,442 B2 3/2010 Walton
7,695,812 B2 4/2010 Peng
7,714,071 B2 5/2010 Hoenig
7,732,052 B2 6/2010 Chang
7,737,061 B2 6/2010 Chang
7,737,215 B2 6/2010 Chang
7,741,397 B2 6/2010 Liang
7,754,814 B2 7/2010 Barcus
7,759,404 B2 7/2010 Burgun
7,786,216 B2 8/2010 Soediono
7,795,321 B2 9/2010 Cheung
7,803,728 B2 9/2010 Poon
7,811,644 B2 10/2010 DeBraal
7,818,866 B2 10/2010 Hollis
7,820,282 B2 10/2010 Haas
7,841,974 B2 11/2010 Hartjes
7,842,770 B2 11/2010 Liang
7,858,706 B2 12/2010 Arriola
7,863,379 B2 1/2011 Kapur
7,883,769 B2 2/2011 Seth
7,893,166 B2 2/2011 Shan
7,897,689 B2 3/2011 Harris
7,906,587 B2 3/2011 Poon
7,910,658 B2 3/2011 Chang

(56) References Cited

U.S. PATENT DOCUMENTS

| | | | |
|---|---|---|---|
| 7,915,192 | B2 | 3/2011 | Arriola |
| 7,918,005 | B2 | 4/2011 | Hollis |
| 7,918,016 | B2 | 4/2011 | Hollis |
| 7,922,071 | B2 | 4/2011 | Robertson |
| 7,928,162 | B2 | 4/2011 | Kiss |
| 7,935,740 | B2 | 5/2011 | Dang |
| 7,947,367 | B2 | 5/2011 | Poon |
| 7,951,882 | B2 | 5/2011 | Arriola |
| 7,977,397 | B2 | 7/2011 | Cheung |
| 7,989,543 | B2 | 8/2011 | Karjala |
| 7,993,254 | B2 | 8/2011 | Robertson |
| 7,998,579 | B2 | 8/2011 | Lin |
| 7,998,728 | B2 | 8/2011 | Rhoads |
| 8,003,176 | B2 | 8/2011 | Ylitalo |
| 8,003,744 | B2 | 8/2011 | Okamoto |
| 8,012,550 | B2 | 9/2011 | Ylitalo |
| 8,026,291 | B2 | 9/2011 | Handa |
| 8,043,695 | B2 | 10/2011 | Ballard |
| 8,067,319 | B2 | 11/2011 | Poon |
| 8,076,381 | B2 | 12/2011 | Miyagawa |
| 8,076,416 | B2 | 12/2011 | Ellul |
| 8,084,537 | B2 | 12/2011 | Walton |
| 8,087,147 | B2 | 1/2012 | Hollis |
| 8,105,459 | B2 | 1/2012 | Alvarez |
| 8,119,237 | B2 | 2/2012 | Peng |
| 8,124,234 | B2 | 2/2012 | Weaver |
| 8,173,233 | B2 | 5/2012 | Rogers |
| 8,198,374 | B2 | 6/2012 | Arriola |
| 8,211,982 | B2 | 7/2012 | Harris |
| 8,227,075 | B2 | 7/2012 | Matsushita |
| 8,273,068 | B2 | 9/2012 | Chang |
| 8,273,826 | B2 | 9/2012 | Walton |
| 8,273,838 | B2 | 9/2012 | Shan |
| 8,288,470 | B2 | 10/2012 | Ansems |
| 8,304,496 | B2 | 11/2012 | Weaver |
| 8,404,780 | B2 | 3/2013 | Weaver |
| 8,435,615 | B2 | 5/2013 | Tsuchida |
| 8,679,620 | B2 | 3/2014 | Matsushita |
| 8,883,280 | B2 | 11/2014 | Leser |
| 2001/0010849 | A1 | 8/2001 | Blizard |
| 2002/0030296 | A1 | 3/2002 | Geddes |
| 2002/0058126 | A1 | 5/2002 | Kannankeril |
| 2002/0137851 | A1 | 9/2002 | Kim |
| 2002/0144769 | A1 | 10/2002 | Debraal |
| 2002/0172818 | A1 | 11/2002 | DeBraal |
| 2003/0003251 | A1 | 1/2003 | DeBraal |
| 2003/0017284 | A1 | 1/2003 | Watanabe |
| 2003/0029876 | A1 | 2/2003 | Giraud |
| 2003/0108695 | A1 | 6/2003 | Freek |
| 2003/0138515 | A1 | 7/2003 | Harfmann |
| 2003/0211310 | A1 | 11/2003 | Haas |
| 2003/0228336 | A1 | 12/2003 | Gervasio |
| 2003/0232210 | A1 | 12/2003 | Haas |
| 2004/0031714 | A1 | 2/2004 | Hanson |
| 2004/0038018 | A1 | 2/2004 | Anderson |
| 2004/0115418 | A1 | 6/2004 | Anderson |
| 2004/0170814 | A1 | 9/2004 | VanHandel |
| 2005/0003122 | A1 | 1/2005 | Debraal |
| 2005/0006449 | A1 | 1/2005 | DAmato |
| 2005/0101926 | A1 | 5/2005 | Ausen |
| 2005/0104365 | A1 | 5/2005 | Haas |
| 2005/0121457 | A1 | 6/2005 | Wilson |
| 2005/0147807 | A1 | 7/2005 | Haas |
| 2005/0159496 | A1 | 7/2005 | Bambara |
| 2005/0184136 | A1 | 8/2005 | Baynum, III |
| 2005/0236294 | A1 | 10/2005 | Herbert |
| 2005/0256215 | A1 | 11/2005 | Burnham |
| 2005/0272858 | A1 | 12/2005 | Pierini |
| 2005/0288383 | A1 | 12/2005 | Haas |
| 2006/0000882 | A1 | 1/2006 | Darzinskas |
| 2006/0095151 | A1 | 5/2006 | Mannlein |
| 2006/0135699 | A1 | 6/2006 | Li |
| 2006/0148920 | A1 | 7/2006 | Musgrave |
| 2006/0178478 | A1 | 8/2006 | Ellul |
| 2006/0198983 | A1 | 9/2006 | Patel |
| 2006/0199006 | A1 | 9/2006 | Poon |
| 2006/0199030 | A1 | 9/2006 | Liang |
| 2006/0199744 | A1 | 9/2006 | Walton |
| 2006/0199872 | A1 | 9/2006 | Prieto |
| 2006/0199884 | A1 | 9/2006 | Hoenig |
| 2006/0199887 | A1 | 9/2006 | Liang |
| 2006/0199896 | A1 | 9/2006 | Walton |
| 2006/0199897 | A1 | 9/2006 | Karjala |
| 2006/0199905 | A1 | 9/2006 | Hughes |
| 2006/0199906 | A1 | 9/2006 | Walton |
| 2006/0199907 | A1 | 9/2006 | Chang |
| 2006/0199908 | A1 | 9/2006 | Cheung |
| 2006/0199910 | A1 | 9/2006 | Walton |
| 2006/0199911 | A1 | 9/2006 | Markovich |
| 2006/0199912 | A1 | 9/2006 | Fuchs |
| 2006/0199914 | A1 | 9/2006 | Harris |
| 2006/0199930 | A1 | 9/2006 | Shan |
| 2006/0199931 | A1 | 9/2006 | Poon |
| 2006/0199933 | A1 | 9/2006 | Okamoto |
| 2006/0205833 | A1 | 9/2006 | Martinez |
| 2006/0211819 | A1 | 9/2006 | Hoenig |
| 2006/0234033 | A1 | 10/2006 | Nishikawa |
| 2006/0289609 | A1 | 12/2006 | Fritz |
| 2006/0289610 | A1 | 12/2006 | Kling |
| 2007/0010616 | A1 | 1/2007 | Kapur |
| 2007/0032600 | A1 | 2/2007 | Mogami |
| 2007/0056964 | A1 | 3/2007 | Holcomb |
| 2007/0065615 | A1 | 3/2007 | Odle |
| 2007/0066756 | A1 | 3/2007 | Poon |
| 2007/0078222 | A1 | 4/2007 | Chang |
| 2007/0095837 | A1 | 5/2007 | Meier |
| 2007/0112127 | A1 | 5/2007 | Soediono |
| 2007/0141188 | A1 | 6/2007 | Kim |
| 2007/0155900 | A1 | 7/2007 | Chang |
| 2007/0167315 | A1 | 7/2007 | Arriola |
| 2007/0167575 | A1 | 7/2007 | Weaver |
| 2007/0167578 | A1 | 7/2007 | Arriola |
| 2007/0202330 | A1 | 8/2007 | Peng |
| 2007/0219334 | A1 | 9/2007 | Shan |
| 2008/0118738 | A1 | 5/2008 | Boyer |
| 2008/0121681 | A1 | 5/2008 | Wiedmeyer |
| 2008/0156857 | A1 | 7/2008 | Johnston |
| 2008/0177242 | A1 | 7/2008 | Chang |
| 2008/0227877 | A1 | 9/2008 | Stadlbauer |
| 2008/0234435 | A1 | 9/2008 | Chang |
| 2008/0260996 | A1 | 10/2008 | Heilman |
| 2008/0269388 | A1 | 10/2008 | Markovich |
| 2008/0280517 | A1 | 11/2008 | Chang |
| 2008/0281037 | A1 | 11/2008 | Karjala |
| 2008/0311812 | A1 | 12/2008 | Arriola |
| 2009/0042472 | A1 | 2/2009 | Poon |
| 2009/0068402 | A1 | 3/2009 | Yoshida |
| 2009/0069523 | A1 | 3/2009 | Itakura |
| 2009/0076216 | A1 | 3/2009 | Kiss |
| 2009/0105417 | A1 | 4/2009 | Walton |
| 2009/0110944 | A1 | 4/2009 | Aguirre |
| 2009/0170679 | A1 | 7/2009 | Hartjes |
| 2009/0220711 | A1 | 9/2009 | Chang |
| 2009/0247033 | A1 | 10/2009 | Peng |
| 2009/0263645 | A1 | 10/2009 | Barger |
| 2009/0275690 | A1 | 11/2009 | Weaver et al. |
| 2009/0324914 | A1 | 12/2009 | Lieng |
| 2010/0025073 | A1 | 2/2010 | Fagrell |
| 2010/0028568 | A1 | 2/2010 | Weaver |
| 2010/0029827 | A1 | 2/2010 | Ansems |
| 2010/0040818 | A1 | 2/2010 | Farha |
| 2010/0055358 | A1 | 3/2010 | Weaver |
| 2010/0069574 | A1 | 3/2010 | Shan |
| 2010/0093942 | A1 | 4/2010 | Silvis |
| 2010/0137118 | A1 | 6/2010 | Chang |
| 2010/0168267 | A1 | 7/2010 | Dang |
| 2010/0181328 | A1 | 7/2010 | Cook |
| 2010/0181370 | A1 | 7/2010 | Berbert |
| 2010/0196610 | A1 | 8/2010 | Chang |
| 2010/0240818 | A1 | 9/2010 | Walton |
| 2010/0279571 | A1 | 11/2010 | Poon |
| 2010/0324202 | A1 | 12/2010 | Bafna |
| 2011/0003929 | A1 | 1/2011 | Soediono |
| 2011/0008570 | A1 | 1/2011 | Seth |

(56) References Cited

U.S. PATENT DOCUMENTS

| | | | | |
|---|---|---|---|---|
| 2011/0009513 | A1 | 1/2011 | Chaudhary | |
| 2011/0091688 | A1 | 4/2011 | Maurer | |
| 2011/0104414 | A1 | 5/2011 | Onodera | |
| 2011/0111150 | A1 | 5/2011 | Matsuzaki | |
| 2011/0118370 | A1 | 5/2011 | Jiang | |
| 2011/0118416 | A1 | 5/2011 | Arriola | |
| 2011/0124818 | A1 | 5/2011 | Arriola | |
| 2011/0136959 | A1 | 6/2011 | Brandstetter | |
| 2011/0144240 | A1 | 6/2011 | Harris | |
| 2011/0217492 | A1 | 9/2011 | Stamatiou | |
| 2011/0229693 | A1 | 9/2011 | Maurer | |
| 2011/0230108 | A1 | 9/2011 | Arriola | |
| 2011/0318560 | A1 | 12/2011 | Yun | |
| 2012/0004087 | A1 | 1/2012 | Tharayil | |
| 2012/0024873 | A1 | 2/2012 | Roseblade | |
| 2012/0028065 | A1 | 2/2012 | Bafna | |
| 2012/0041148 | A1 | 2/2012 | Bafna | |
| 2012/0043374 | A1* | 2/2012 | Lemon | 229/400 |
| 2012/0045603 | A1 | 2/2012 | Zerafati | |
| 2012/0108714 | A1 | 5/2012 | Wittner | |
| 2012/0108743 | A1 | 5/2012 | Krishnaswamy | |
| 2012/0125926 | A1 | 5/2012 | Iyori | |
| 2012/0132699 | A1 | 5/2012 | Mann | |
| 2012/0178896 | A1 | 7/2012 | Bastioli | |
| 2012/0184657 | A1 | 7/2012 | Lake | |
| 2012/0193365 | A1 | 8/2012 | Humphries | |
| 2012/0199278 | A1 | 8/2012 | Lee | |
| 2012/0199641 | A1* | 8/2012 | Hsieh | 229/403 |
| 2012/0214890 | A1 | 8/2012 | Senda | |
| 2012/0220730 | A1 | 8/2012 | Li | |
| 2012/0225961 | A1 | 9/2012 | VanHorn | |
| 2012/0237734 | A1 | 9/2012 | Maurer | |
| 2012/0267368 | A1 | 10/2012 | Wu | |
| 2012/0270039 | A1 | 10/2012 | Tynys | |
| 2012/0295994 | A1 | 11/2012 | Bernreitner | |
| 2012/0318805 | A1 | 12/2012 | Leser | |
| 2012/0318807 | A1 | 12/2012 | Leser | |
| 2013/0023598 | A1 | 1/2013 | Song | |
| 2013/0032963 | A1 | 2/2013 | Tokiwa | |
| 2013/0052385 | A1 | 2/2013 | Leser | |
| 2013/0280517 | A1 | 10/2013 | Buehring | |
| 2013/0303645 | A1 | 11/2013 | Dix | |

FOREIGN PATENT DOCUMENTS

| | | | |
|---|---|---|---|
| CN | 1288427 | | 3/2001 |
| CN | 101429309 | | 5/2009 |
| DE | 2831240 | | 1/1980 |
| DE | 2831240 | C | 3/1988 |
| DE | 102006025612 | | 11/2007 |
| DE | 102006025612 | A1 | 11/2007 |
| EP | 0086869 | | 8/1983 |
| EP | 0161597 | | 11/1985 |
| EP | 0318167 | | 5/1989 |
| EP | 0570221 | | 11/1993 |
| EP | 0659647 | | 6/1995 |
| EP | 0972727 | | 1/2000 |
| EP | 0796199 | | 2/2001 |
| EP | 0940240 | | 10/2002 |
| EP | 1308263 | | 5/2003 |
| EP | 1479716 | | 11/2004 |
| EP | 1666530 | | 6/2006 |
| EP | 1754744 | | 2/2007 |
| EP | 1921023 | A1 | 5/2008 |
| EP | 1939099 | | 7/2008 |
| EP | 2266894 | | 12/2010 |
| EP | 2386584 | A1 | 11/2011 |
| GB | 1078326 | | 8/1967 |
| JP | 52123043 | | 10/1977 |
| JP | 52123043 | U | 10/1977 |
| JP | 58029618 | | 2/1983 |
| JP | 3140847 | | 1/1994 |
| JP | P310847 | | 12/2000 |
| JP | 2001310429 | | 11/2001 |
| JP | 2003292663 | | 10/2003 |
| JP | 2004018101 | | 1/2004 |
| JP | 2004168421 | | 6/2004 |
| JP | 2004168421 | A | 6/2004 |
| JP | 2006096390 | | 4/2006 |
| JP | 2006130814 | A | 5/2006 |
| JP | 2009066856 | A | 4/2009 |
| JP | 2009190756 | A | 8/2009 |
| KR | 100306320 | | 10/2001 |
| KR | 2003036558 | | 5/2003 |
| KR | 2004017234 | | 2/2004 |
| KR | 101196666 | | 11/2012 |
| WO | 9413460 | | 6/1994 |
| WO | 9729150 | | 8/1997 |
| WO | 9816575 | | 4/1998 |
| WO | 0119733 | | 3/2001 |
| WO | 0132758 | | 5/2001 |
| WO | 0153079 | | 7/2001 |
| WO | 03076497 | | 9/2003 |
| WO | 03099913 | | 12/2003 |
| WO | 2004104075 | | 12/2004 |
| WO | 2006042908 | | 4/2006 |
| WO | 2006124369 | | 11/2006 |
| WO | 2007020074 | | 2/2007 |
| WO | 2008030953 | | 3/2008 |
| WO | 2008038750 | | 4/2008 |
| WO | 2008045944 | | 4/2008 |
| WO | 2008057878 | | 5/2008 |
| WO | 2008080111 | | 7/2008 |
| WO | 2009035580 | | 3/2009 |
| WO | 2010006272 | | 1/2010 |
| WO | 2010019146 | | 2/2010 |
| WO | 2010076701 | A1 | 7/2010 |
| WO | 2010111869 | | 10/2010 |
| WO | 2011005856 | | 1/2011 |
| WO | 2011036272 | A2 | 3/2011 |
| WO | 2011076637 | | 6/2011 |
| WO | 2011141044 | | 11/2011 |
| WO | 2012020106 | | 2/2012 |
| WO | 2012025584 | | 3/2012 |
| WO | 2012044730 | | 4/2012 |
| WO | 2012055797 | | 5/2012 |
| WO | 2012099682 | | 7/2012 |

OTHER PUBLICATIONS

International Search Report dated Jul. 29, 2013, relating to International Application No. PCT/US2012/043016, 25 pages.

International Search Report and Written Opinion dated Sep. 17, 2013, relating to International Application No. PCT/US2012/041395.

International Search Report dated Feb. 26, 2013, relating to International Application No. PCT/US2012/043018.

International Search Report dated Jan. 29, 2013, relating to International Application No. PCT/US2012/043017.

International Search Report dated Jan. 30, 2013, relating to International Application No. PCT/US2012/042737.

International Search Report dated Jul. 30, 2012, relating to International Application No. PCT/US2012/041397.

International Search Report dated Nov. 19, 2012, relating to International Application No. PCT/US2012/041395.

Jaakko I. Raukola, A New Technology to Manufacture Polypropylene Foam Sheet and Biaxially Oriented Foam Film, VTT Publications 361, Technical Research Centre of Finland, Apr. 1998, 100 pages.

Borealis AG, Daploy(TM) HMS Polypropylene for Foam Extrusion, 2010, 20 pages.

Machine English translation of JP 2006-130814.

Office Action dated Oct. 10, 2014 for U.S. Appl. No. 14/106,358.

Office Action dated Oct. 16, 2014 for U.S. App.. No. 14/106,212.

New Zealand First Examination Report for Application No. 619616 dated Oct. 10, 2014.

Office action dated Apr. 11, 2014 for U.S. Appl. No. 13/526,417.

Office Action dated Aug. 19, 2014 for Chinese Application No. 201280035667.4.

Office Action dated Aug. 21, 2014 for U.S. Appl. No. 13/526,454.

(56) References Cited

OTHER PUBLICATIONS

Office Action dated Jul. 25, 2014 for U.S. Appl. No. 13/525,640.
Office Action dated Sep. 25, 2014 for U.S. Appl. No. 13/526,417.
International Search Report and Written Opinion dated Apr. 16, 2014, relating to International Application No. PCT/US2013/075013.
International Search Report and Written Opinion dated Apr. 21, 2014, relating to International Application No. PCT/US2013/074923.
International Search Report and Written Opinion dated Apr. 22, 2014, relating to PCT/US2013/074965.
International Search Report and Written Opinion dated Apr. 25, 2014, relating to PCT/US2013/075052.
International Search Report dated Mar. 11, 2014, relating to International Application No. PCT/US2013/66811.
International Search Report and Written Opinion dated Jul. 3, 2014, relating to International Application No. PCT/US2014/025697.
International Search Report and Written Opinion dated Jan. 19, 2015, relating to International Application No. PCT/US2014/059312.
International Search Report dated Jan. 19, 2015, relating to International Application No. PCT/US2014/059216.
Office Action dated Jan. 6, 2015 for Chinese Application No. 201280034350.9 (11 pages).
Office Action dated Jan. 9, 2015 for Chinese Application No. 201280035667.4 (22 pages).
Spanish Search Report of Application No. 201390099, dated Feb. 9, 2015.
European Search Report of Application No. 12861450.0, dated Nov. 21, 2014.
International Search Report dated Nov. 7, 2014, relating to International Application No. PCT/US2014/51508.
Third-Party Submission Under 37 CFR 1.290 filed on Dec. 9, 2014 in U.S. Appl. No. 14/063,252.
Machine English translation of EP0086869.
Singapore Office Action dated Dec. 18, 2014 for Singapore Application No. 2014002273.
Third-Party Submission Under 37 CFR 1.290 filed on Feb. 26, 2015 in U.S. Appl. No. 13/491,007.
Certified English translation of EP0086869.
Office Action dated Apr. 30, 2015 for U.S. Appl. No. 14/462,073.
Office Action dated Apr. 14, 2015 for U.S. Appl. No. 14/106,212.
Office Action dated Apr. 10, 2015 for U.S. Appl. No. 14/106,358.
English translation of Spanish Search Report of Application No. 201490025, dated Apr. 20, 2015.
Spanish Search Report for Application No. 201490025, dated Apr. 20, 2015.
Office Action dated Jun. 23, 2015 for U.S. Appl. No. 13/525,640.
Third Party Submission Under 37 CFR 1.290 in U.S. Appl. No. 14/188,504 submitted May 11, 2015 and May 27, 2015 (43 pages).
Naguib et al., "Fundamental Foaming Mechanisms Governing the Volume Expansion of Extruded Polypropylene Foams," Journal of Applied Polymer Science, vol. 91, pp. 2661-2668, 2004 (10 pages).
Wang et al., "Extending PP\s Foamability Through Tailored Melt Strength and Crystallization Kinetics," paper 19 from the Conference Proceedings of the 8th International Conferences of Blowing Agents and Foaming Processes, May 16-17th, 2006 in Munich, Germany Smithers Rapra Ltd, 2006 (14 pages).

* cited by examiner

BLANK FOR CONTAINER

PRIORITY CLAIM

This application claims priority under 35 U.S.C. §119(e) to U.S. Provisional Application Ser. No. 61/737,406, filed Dec. 14, 2012, which is expressly incorporated by reference herein.

BACKGROUND

The present disclosure relates to vessels, and in particular to blanks for containers. More particularly, the present disclosure relates to a blank for an insulated container formed from polymeric materials.

SUMMARY

A vessel in accordance with the present disclosure is configured to hold a product in an interior region formed in the vessel. In illustrative embodiments, the vessel is an insulated container such as a drink cup, a food-storage cup, or a dessert cup.

In illustrative embodiments, an insulative cup includes a body having a sleeve-shaped side wall and a floor coupled to the body to cooperate with the side wall to form an interior region for storing food, liquid, or any suitable product. The body also includes a rolled brim coupled to an upper end of the side wall and a floor mount interconnecting a lower end of the side wall and the floor.

The insulative cellular non-aromatic polymeric material included in the body is configured in accordance with the present disclosure to provide means for enabling localized plastic deformation in at least one selected region of the body (e.g., the floor mount and a floor-retaining flange included in the floor mount) to provide (1) a plastically deformed first material segment having a first density in a first portion of the selected region of the body and (2) a second material segment having a relatively lower second density in an adjacent second portion of the selected region of the body. In illustrative embodiments, the more dense first material segment is thinner than the second material segment.

A blank of polymeric material in accordance with the present disclosure is used to form a body of a cup. In illustrative embodiments, the blank includes an upper band formed to include a curved top edge and a lower band formed to include a left-end edge, a right-end edge, and a curved bottom edge arranged to extend between the left-end and right-end edges. The lower band is appended to the upper band along a curved fold line to locate the curved fold line between the curved top and bottom edges. The upper band has a relatively long curved top edge and can be formed in a blank conversion process to provide a cup body having a rolled brim and a sleeve-shape side wall extending downwardly from the rolled brim. The lower band has a relatively short curved bottom edge and can be folded about the curved fold line during the blank conversion process to form a portion of a floor mount that is configured to mate with a cup floor to provide a cup.

In illustrative embodiments, the lower band is formed to include a series of high-density staves of a first density and low-density staves of a relatively lower second density. Each stave is arranged to extend from the curved bottom edge of the lower band toward the curved fold line. The high-density and low-density staves are arranged to lie in an alternating sequence extending from the let-end edge of the lower band to the right-end edge of the lower band to cause density to alternate from stave to stave along a length of the lower band.

In illustrative embodiments, each low-density stave in the lower band is relatively thick and wide. Each high-density stave in the lower band is relatively thin and narrow. In other illustrative embodiments, diamond density patterns, diagonal density patterns, and other density patterns are used instead of the high-density and low-density staves.

In illustrative embodiments, a connecting web is defined in the blank by polymeric material extending along and on either side of the curved fold line. After the blank conversion process is completed, the cup body will include a floor mount comprising an annular web-support ring defined by a bottom strip of the upper band, an annular floor-retaining flange surrounded by the annular web-support ring, and an annular connecting web extending along the curved fold line and joining together lower portions of the floor-retaining flange and the surrounding web-support ring to define an upwardly floor-receiving pocket. The connecting web is formed to have a high density that is about the same as the density of one of the high-density staves.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1A is a plan view of a blank of polymeric material that is formed in accordance with the present disclosure to as suggested in FIG. 1B to produce a body of a cup shown in FIG. 1C that can be mated with a floor to form a cup as shown, for example, in FIGS. 2A and 2B and showing that the body blank includes a side wall and a floor mount coupled to a lower portion of the side wall and also showing that the blank includes a curved lower band along the bottom of the blank and a fan-shaped upper band appended to the curved lower band along a web including a curved fold line;

Figure 1A:
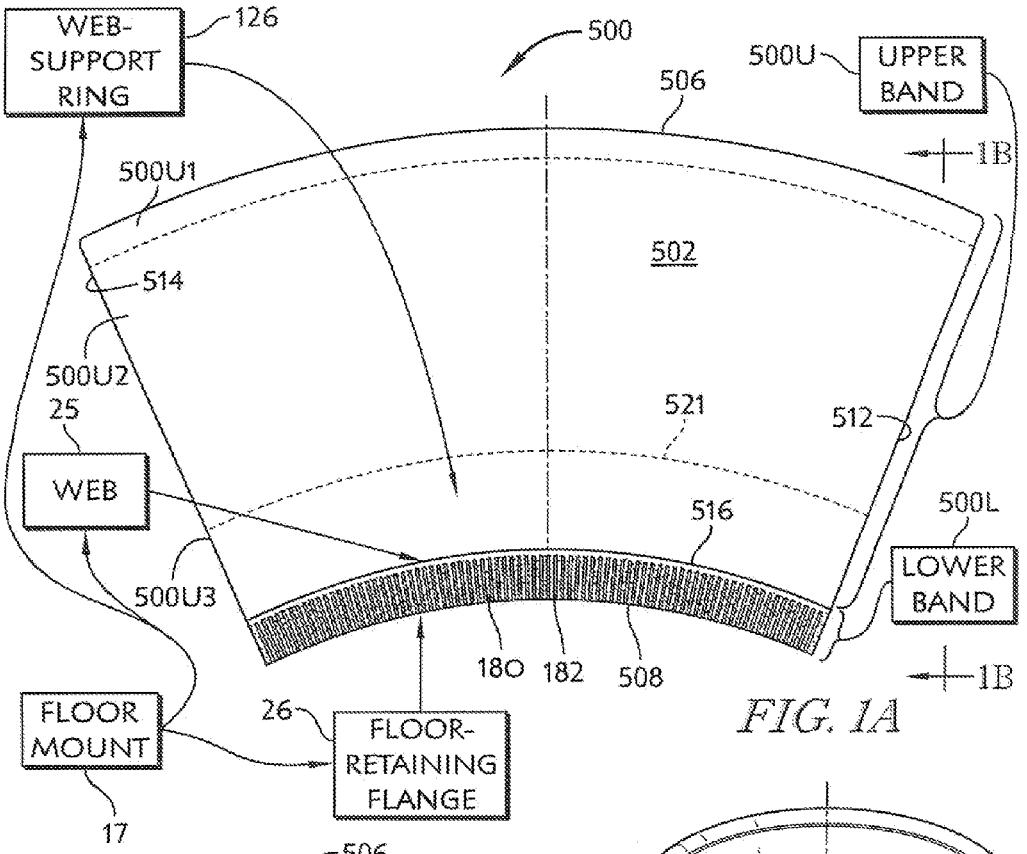
FIG. 1B is an end elevation view of the body blank of FIG. 1A suggesting that a floor-retaining flange can be folded inwardly and upwardly about a fold line associated with a web-support ring included in the floor mount to form an upwardly opening floor-receiving pocket.
FIG. 1C is a reduced-size view of a body formed in a blank conversion process using the body blank of FIGS. 1A and 1B before a floor is coupled to the body as suggested in FIGS. 2A and 2B to form a cup having an interior region bounded by the body and the floor.
Figure 2A:
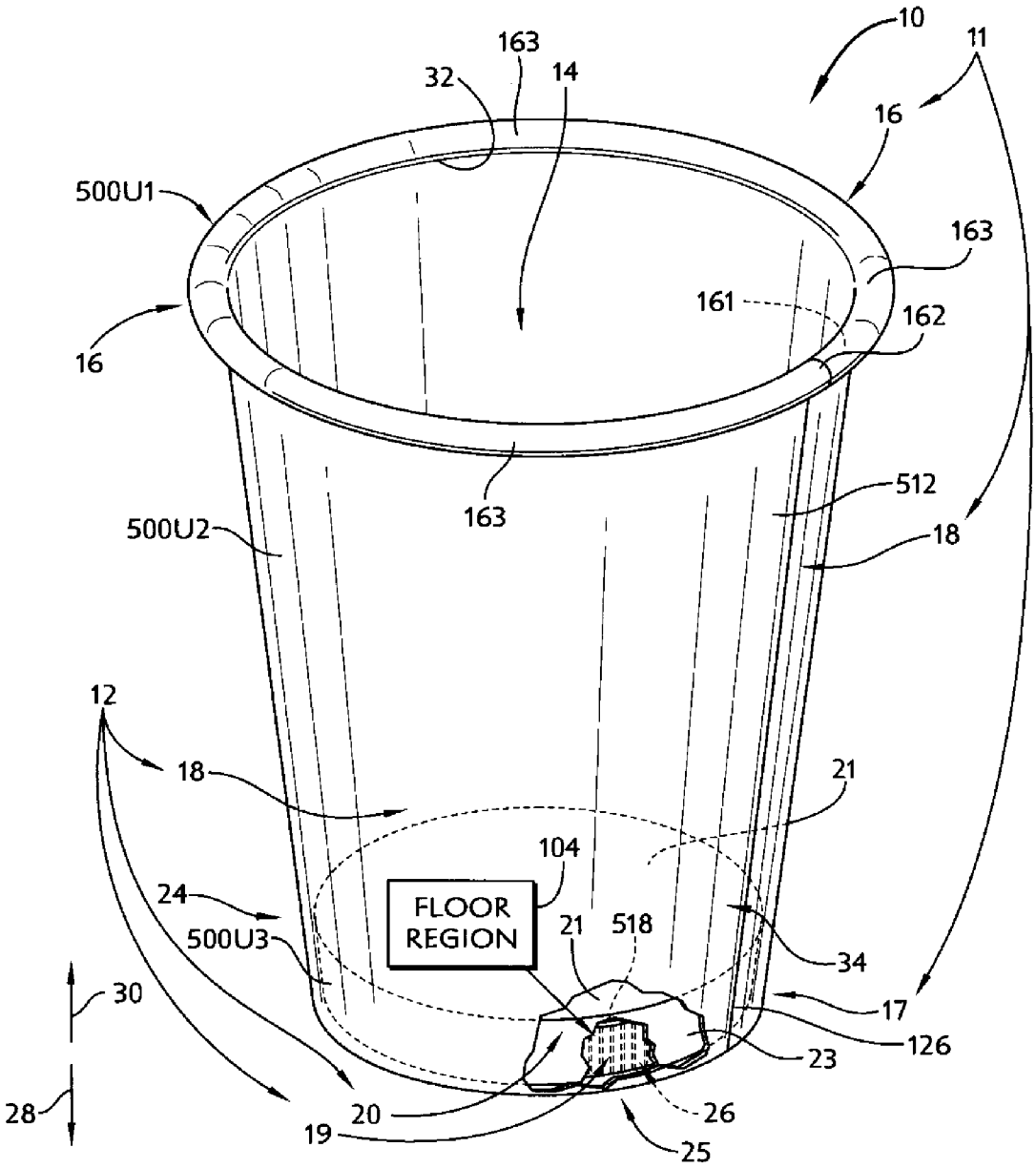
Figure 2B:
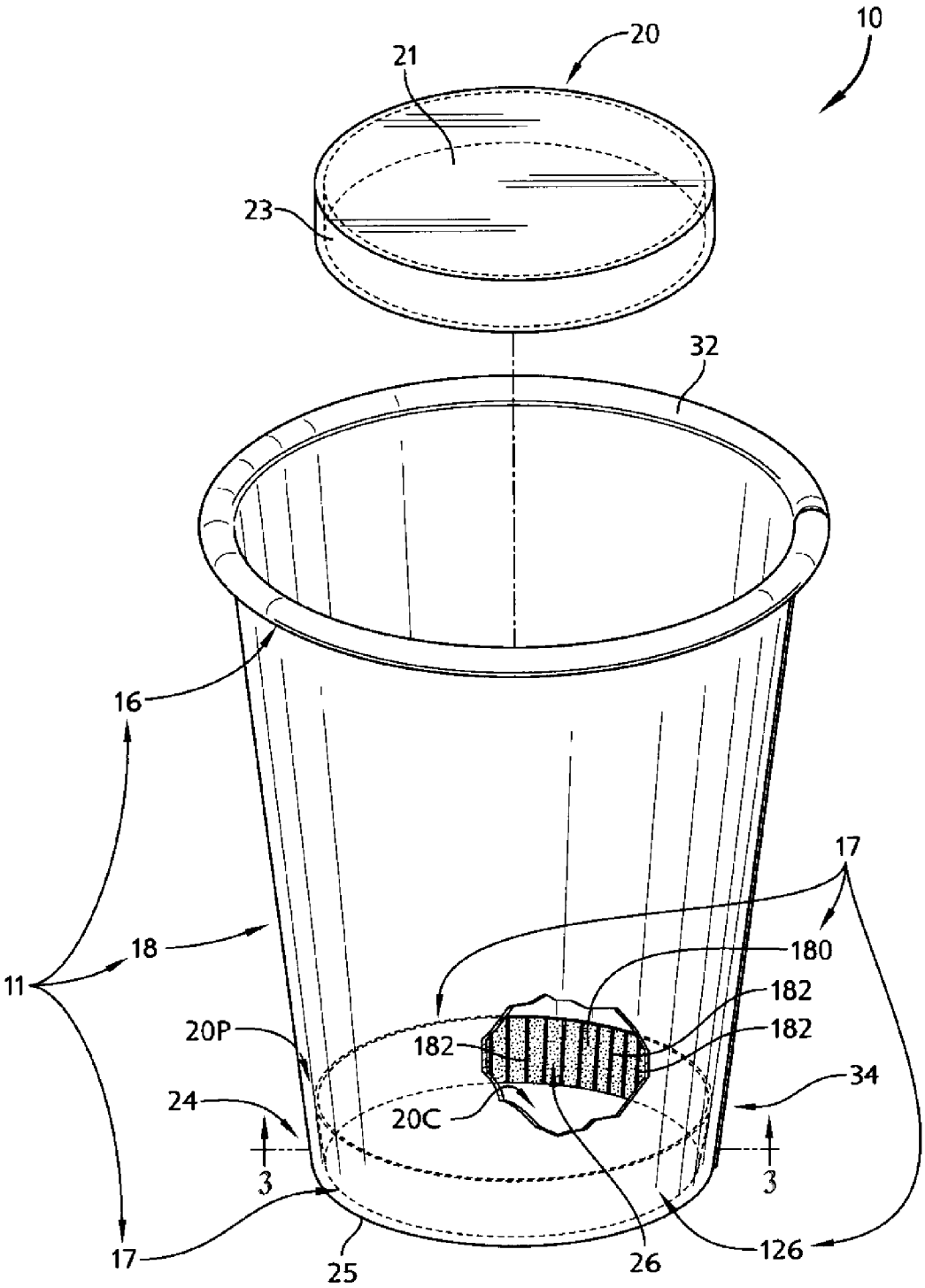
Figure 3:
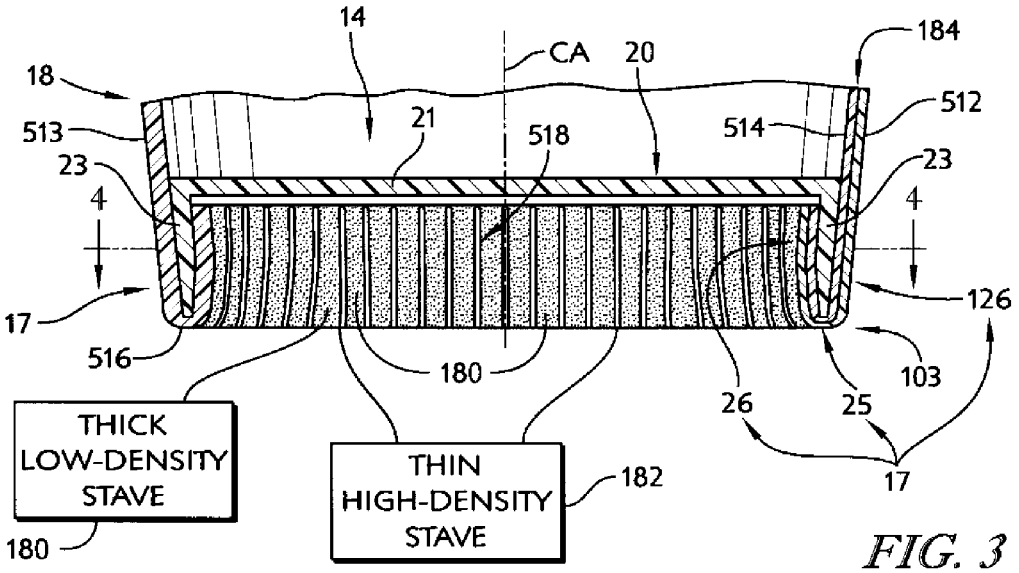
Figure 4:
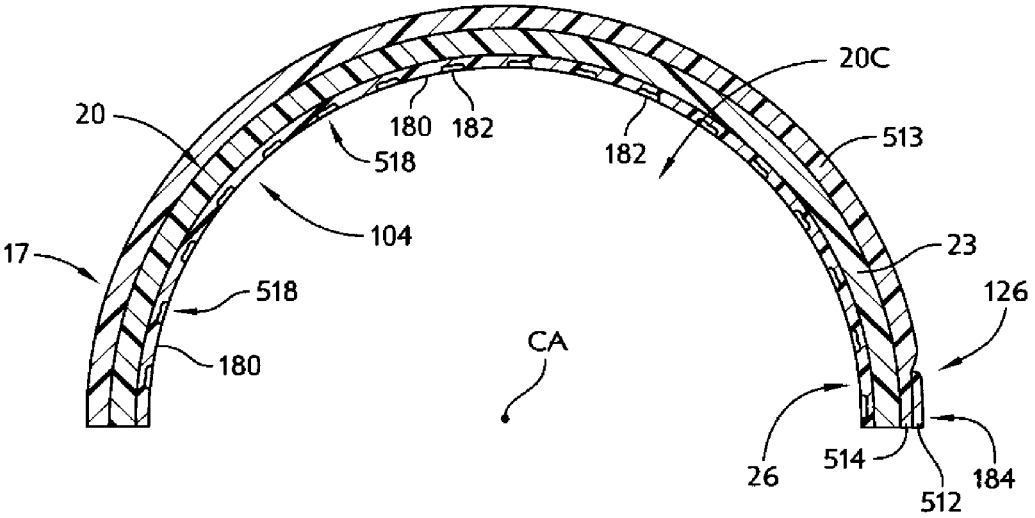
Figure 5:
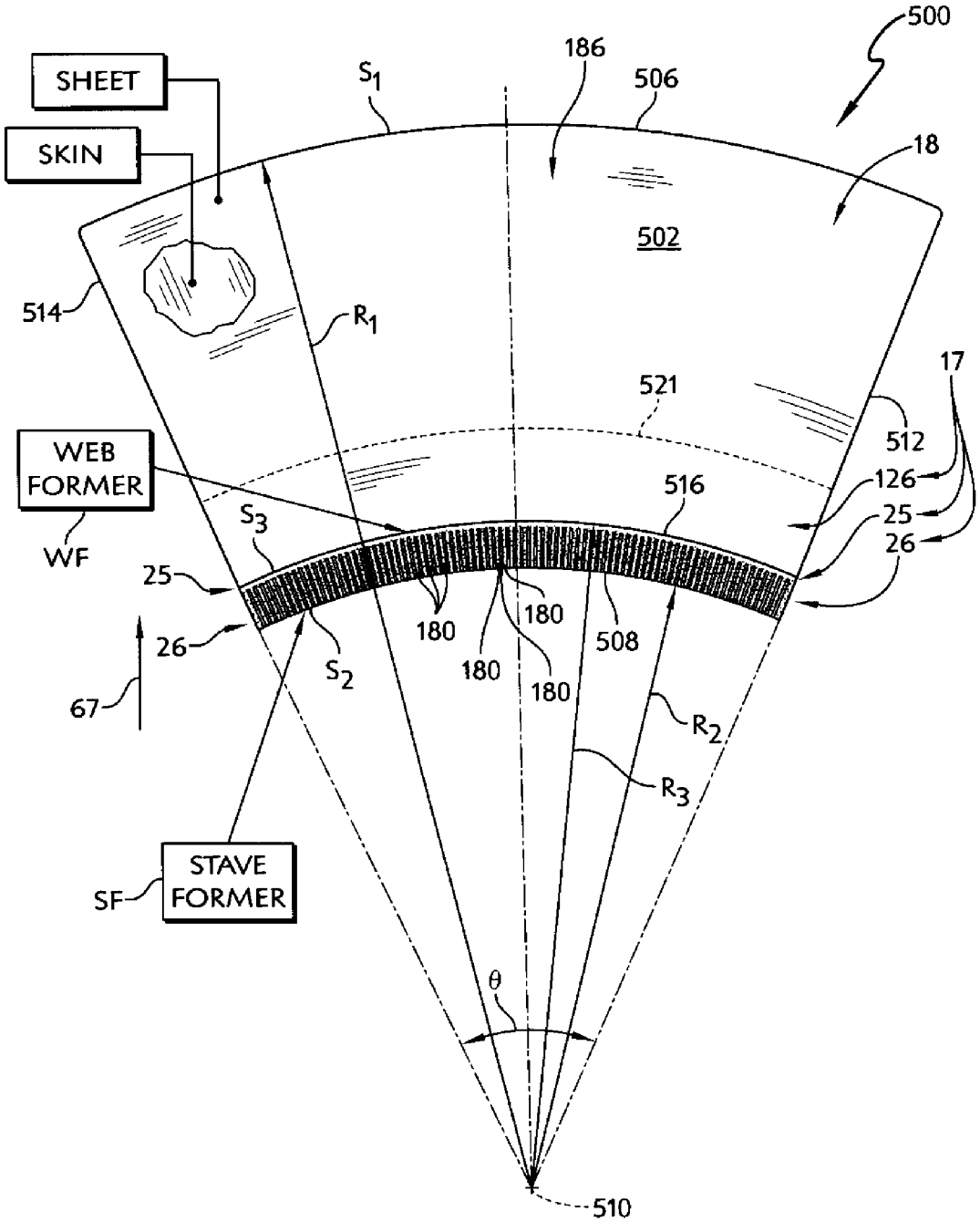
Figure 6:
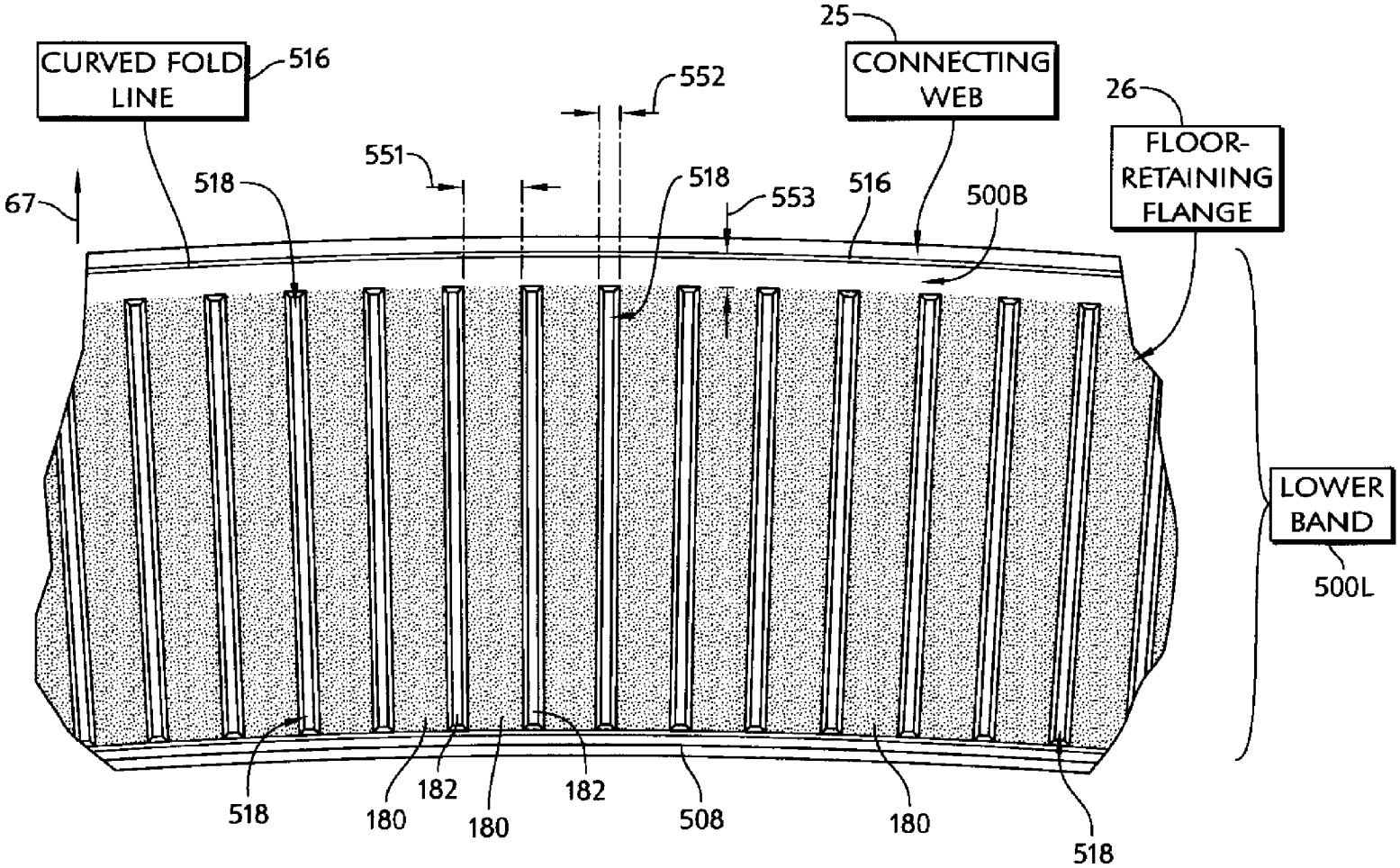
Figure 7:
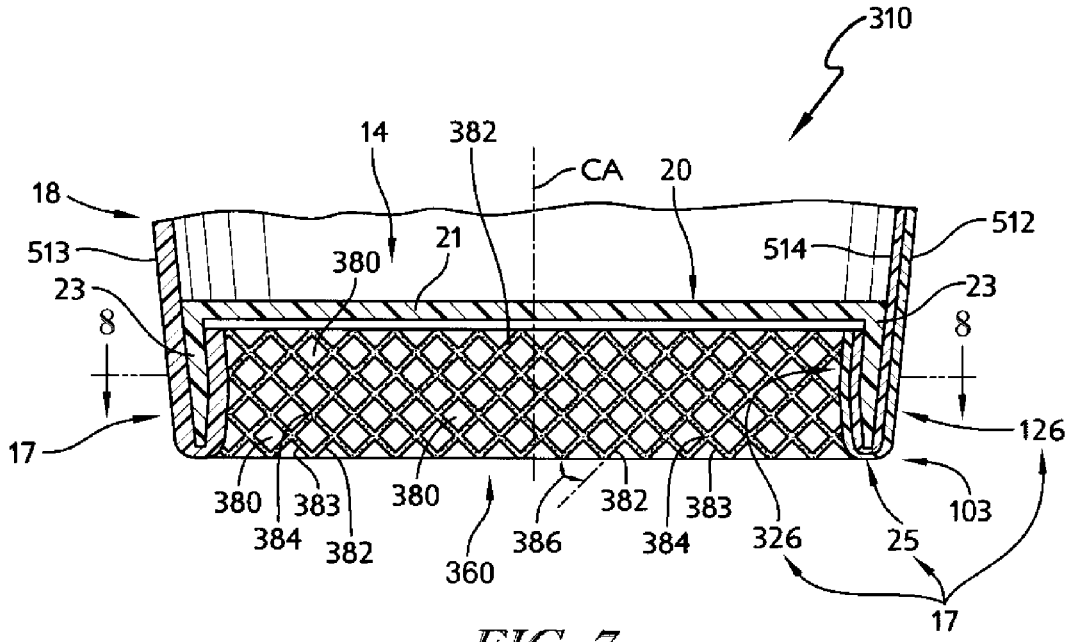
Figure 8:
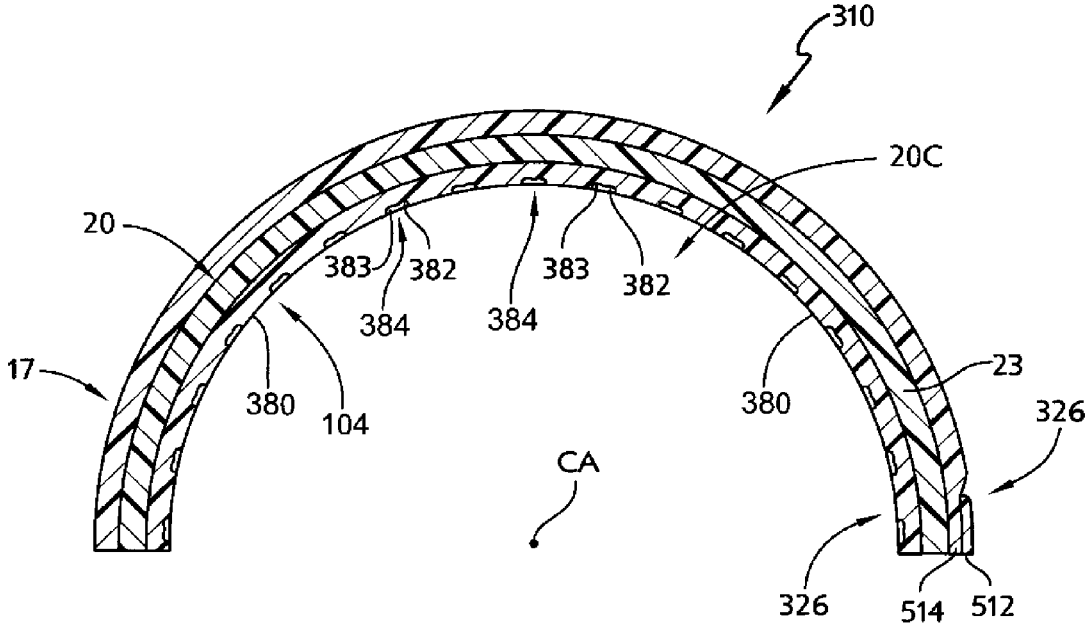
Figure 9:
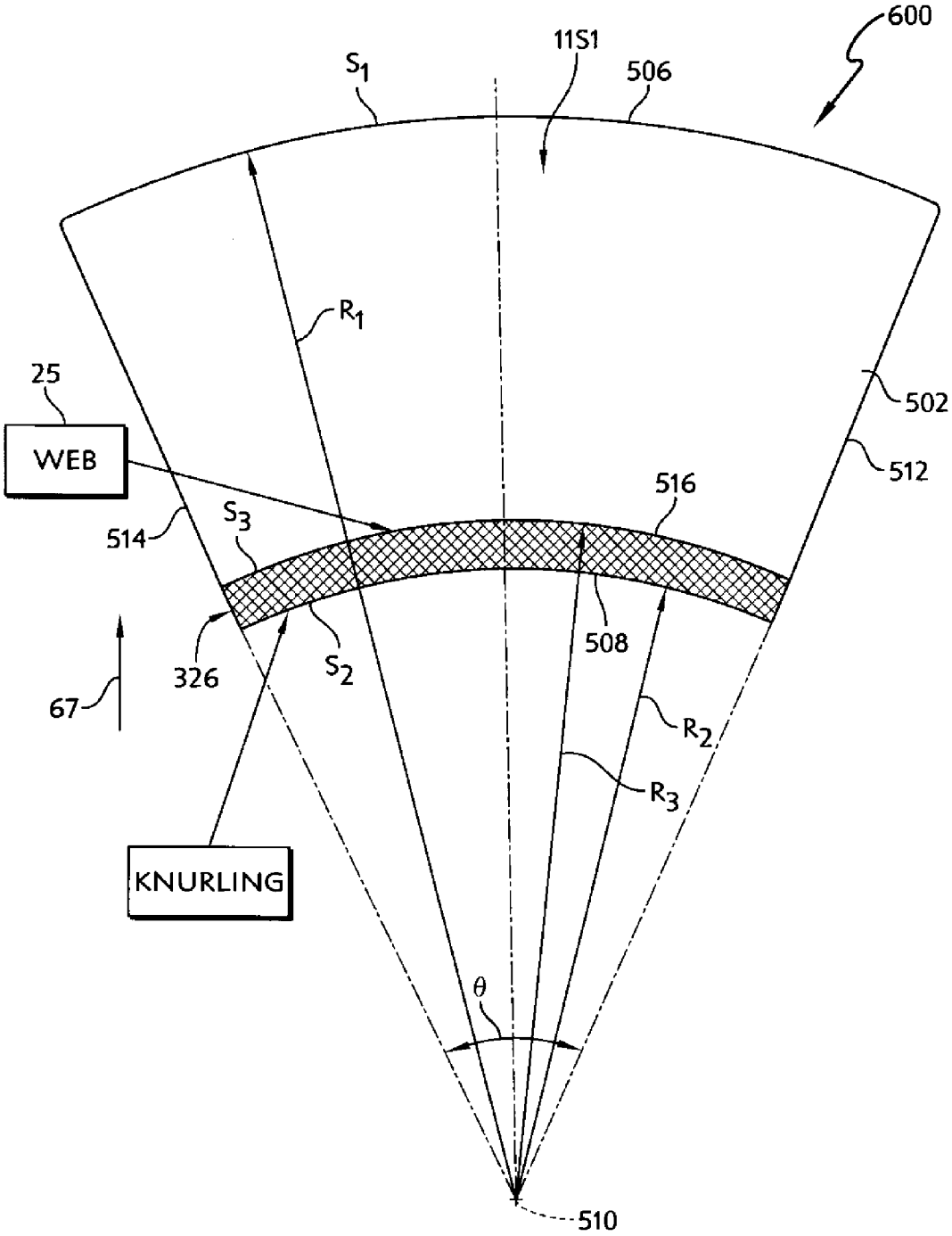
Figure 10:
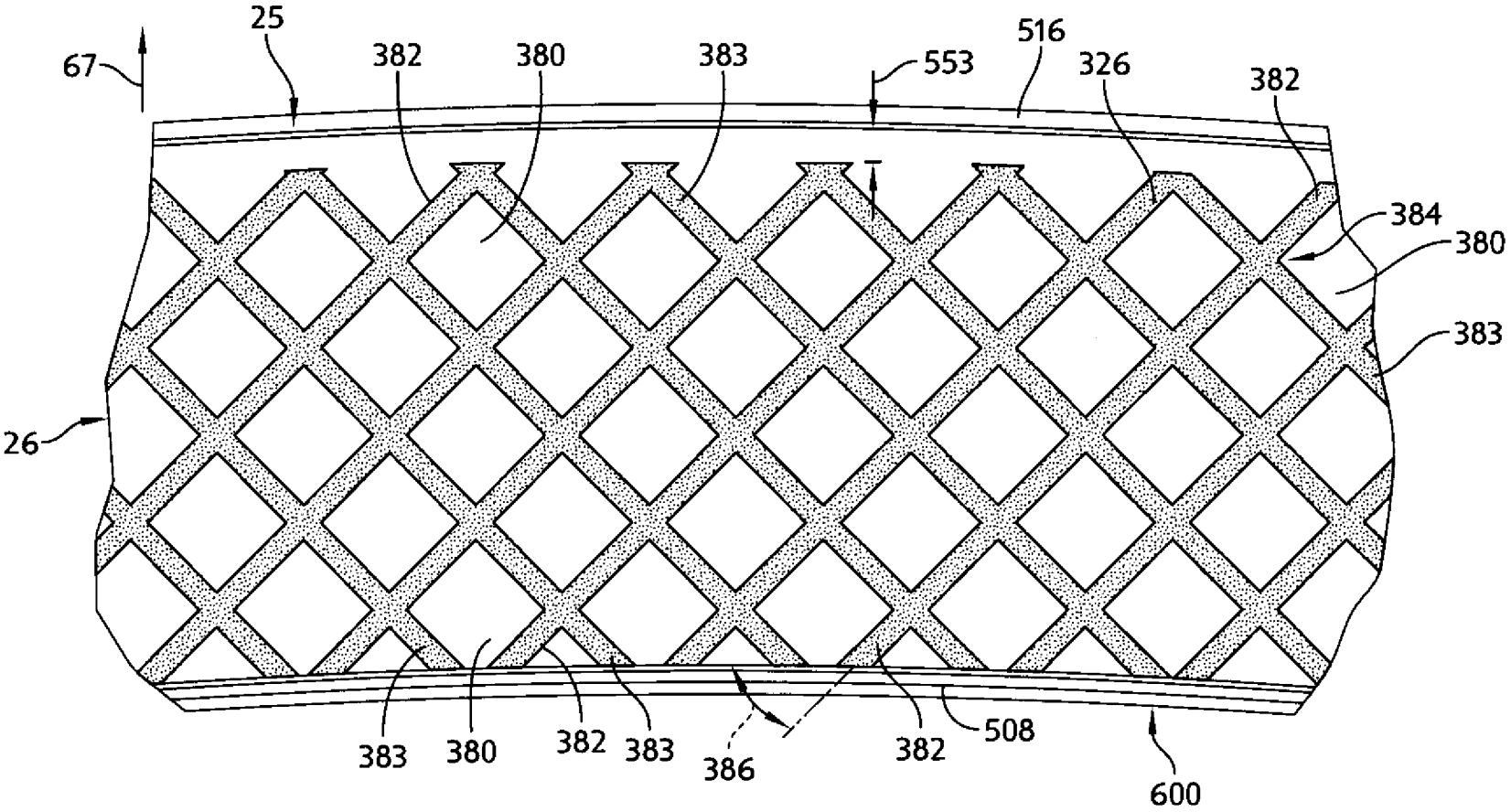
Figure 11:
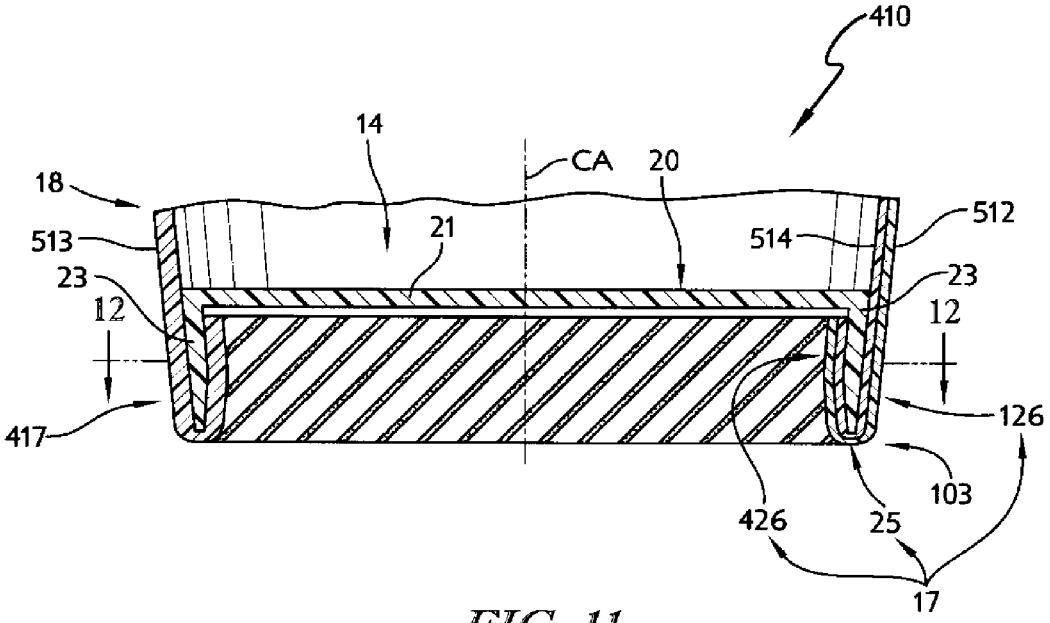
Figure 12:
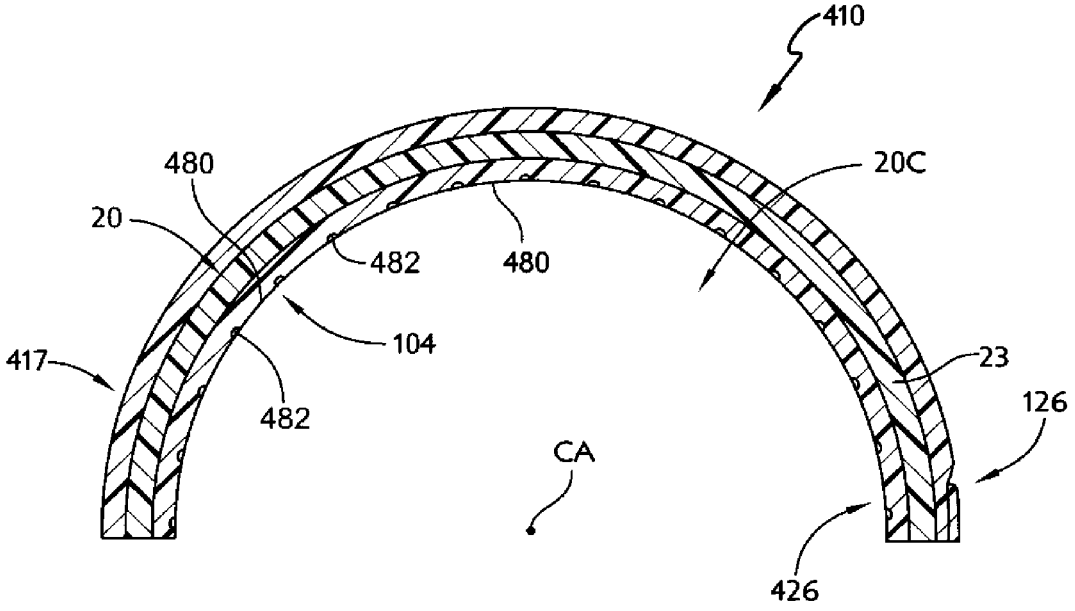
Figure 13:
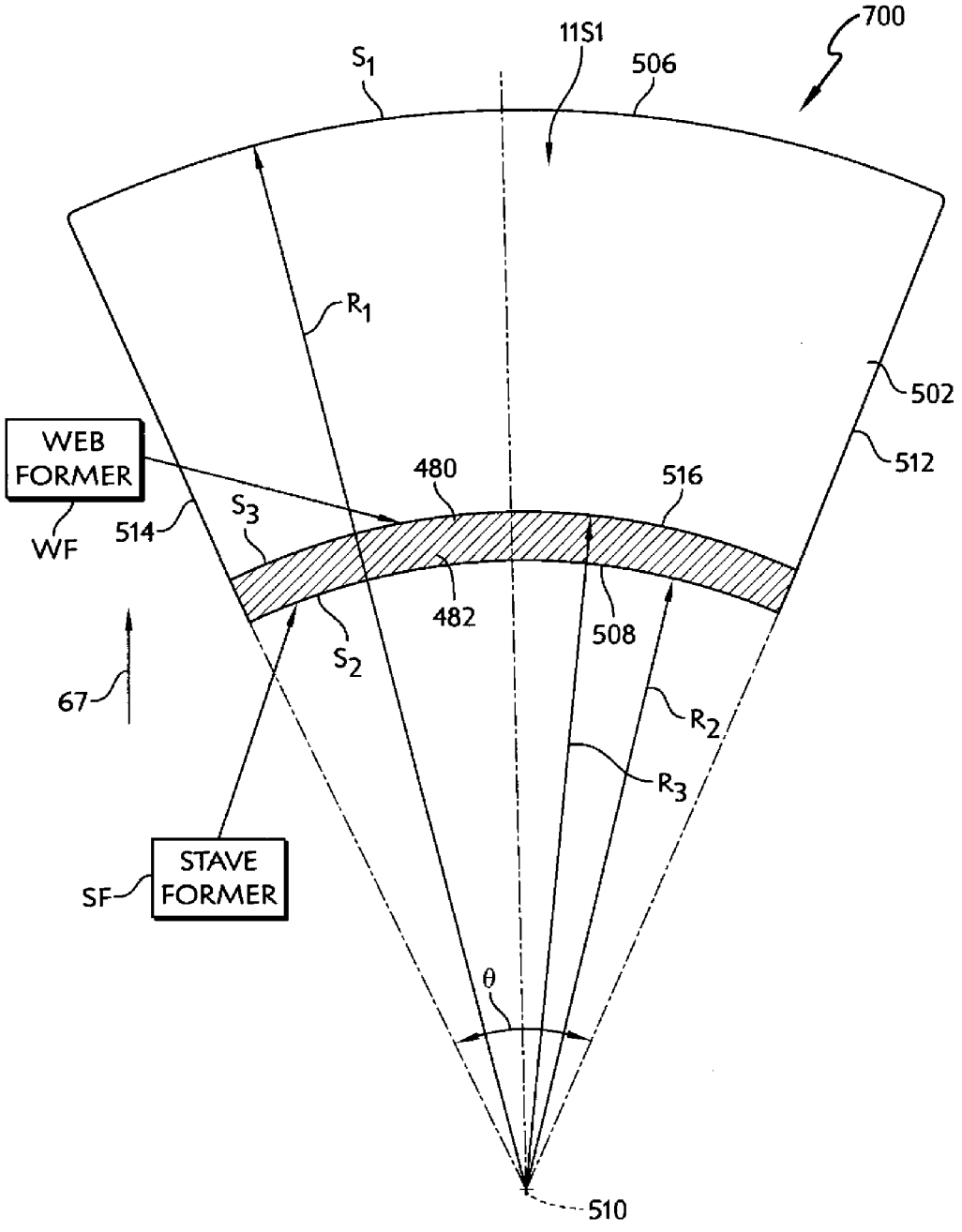
Figure 14:
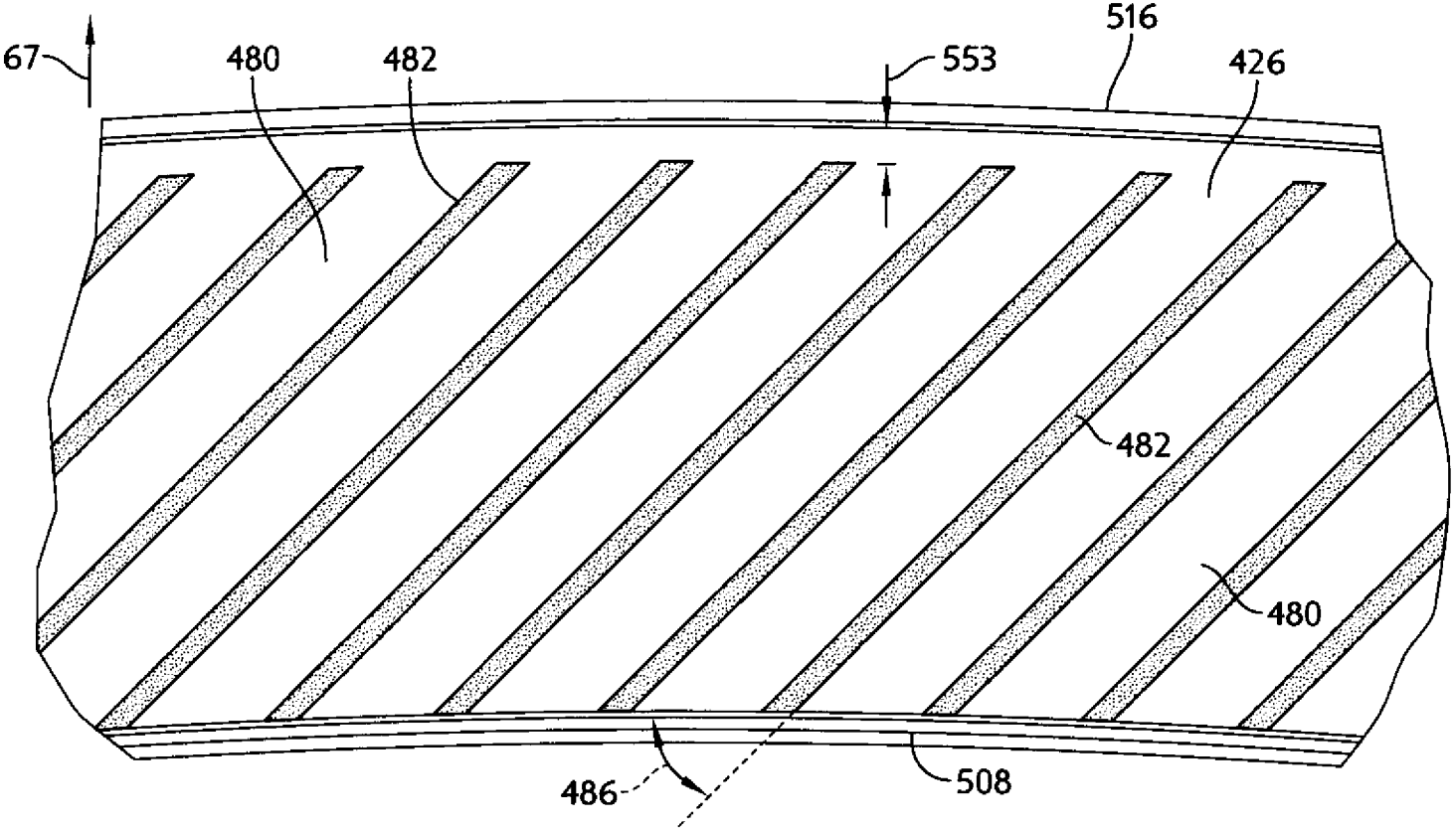
Figure 15:
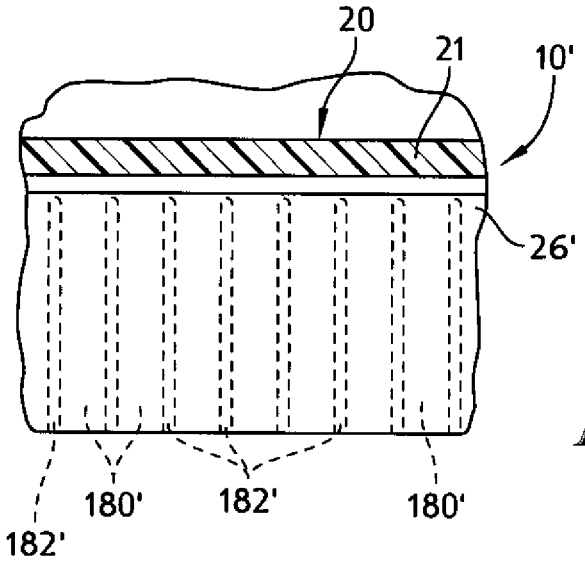
Figure 16:
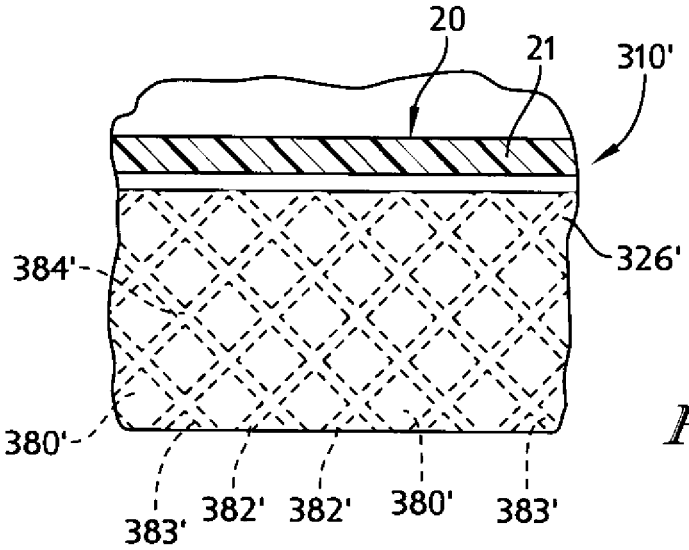
Figure 17:
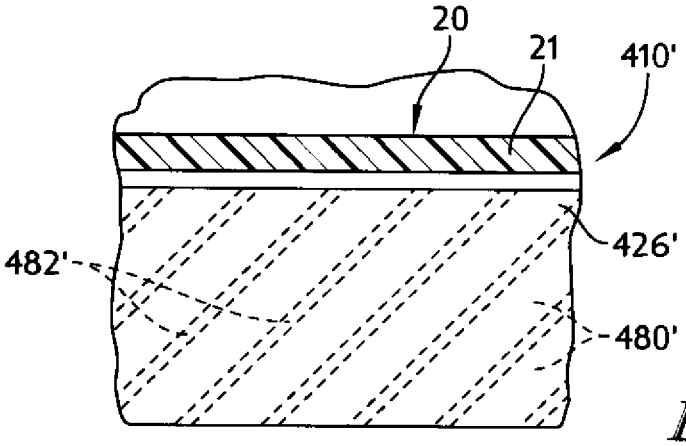
Figure 18:
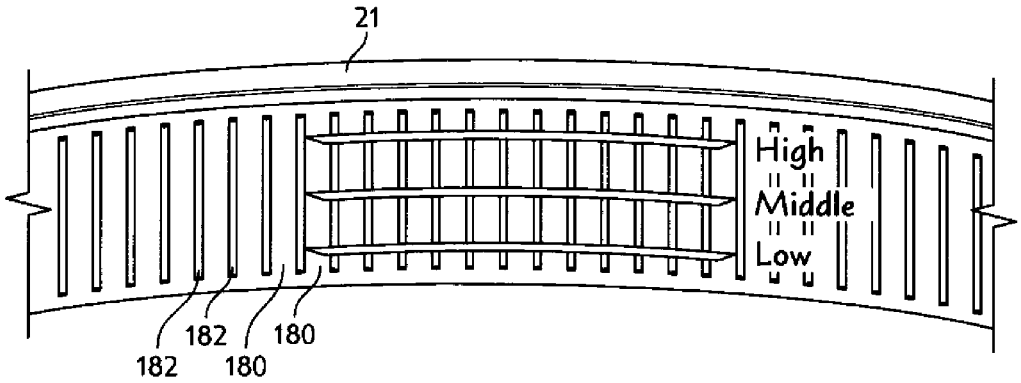
Figure 19:
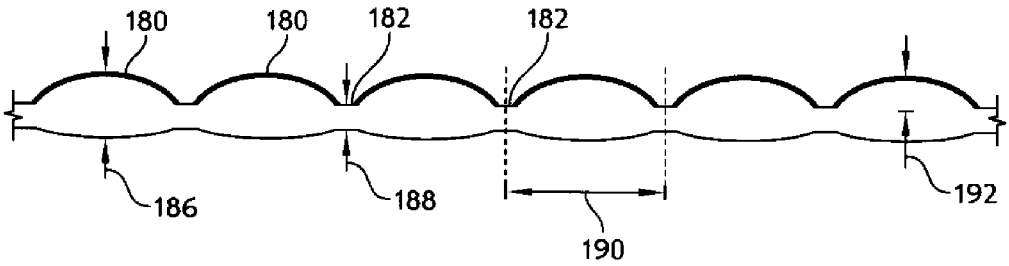

FIG. 2A is a perspective view of an insulative cup made using the polymeric blank shown in FIG. 1A in accordance with the present disclosure showing that the insulative cup includes a body and a floor and showing that a floor region of the body includes a localized area of plastic deformation that provides for increased density in that localized area while maintaining a predetermined insulative characteristic in the body;

FIG. 2B is an exploded assembly view of the insulative cup of FIG. 2A showing that the insulative cup includes, from bottom to top, the floor and the body including a rolled brim, a side wall, and a floor mount configured to mate with the floor as shown in FIG. 2A and showing that the floor mount includes a floor-retaining flange having a series of vertically extending wide (low-density) and narrow (high-density) staves arranged to lie in an alternating sequence in side-by-side relation to one another and shown in an opening formed in the side wall;

FIG. 3 is a partial section view taken along line 3-3 of FIG. 2B showing that the floor region including the localized area of plastic deformation lies in the floor-retaining flange included in the floor mount of the body and showing a first series of spaced-apart depressions formed in an outer surface of the floor-retaining flange and aligned with the narrow and thin (high-density) staves;

FIG. 4 is a partial section view taken along line 4-4 of FIG. 3 showing the first series of spaced-apart depressions formed in the radially inwardly facing outer surface of the floor-retaining flange and arranged to lie in circumferentially spaced-apart relation to one another;

FIG. 5 is a plan view of a body blank shown in FIG. 1 and used to make the body of FIG. 2B with portions broken away to reveal that the body blank is formed from a strip of insulative cellular non-aromatic polymeric material and a skin laminated to the strip of insulative cellular non-aromatic polymeric material and showing that during a blank forming process a web former compresses a portion of the body blank along a curved fold line to form the connecting web and a stave former compresses another portion of the body blank between the curved fold line and a curved bottom edge to form a series of (1) wide and thick (low-density) staves and (2) narrow and thin (high-density) staves that lie between the curved fold line and the curved bottom edge and extending in an alternating sequence from a left-end edge of the blank to a right-end edge of the blank;

FIG. 6 is an enlarged partial plan view of the body blank of FIG. 5 showing the curved fold line and the alternating sequence of wide low-density staves and narrow high-density staves formed in the floor-retaining flange;

FIG. 7 is a partial section view similar to FIG. 3 showing a second embodiment of a variable density pattern formed in the outer surface of the floor-retaining flange included in a floor mount of a cup body;

FIG. 8 is a view similar to FIG. 4 showing the second series of spaced-apart depressions formed in the radially inwardly facing outer surface of the floor-retaining flange;

FIG. 9 is a plan view of a body blank similar to FIG. 5 showing that the knurling former compresses the body blank between a curved fold line and a curved bottom edge to form a set of diamond-shaped portions that extend between the curved fold line and the curved bottom edge, each one of the diamond-shaped portions corresponding to one of the plurality of diamond-shaped ribs;

FIG. 10 is an enlarged partial plan view of the body blank of FIG. 9 showing the curved fold line and the set of diamond-shaped portions formed in the floor-retaining flange;

FIG. 11 is a partial section view similar to FIGS. 3 and 7 showing a third embodiment of a variable density pattern formed in the outer surface of the floor-retaining flange;

FIG. 12 is a view similar to FIGS. 4 and 8 showing the third series of spaced-apart depressions formed in the radially inwardly facing outer surface of the floor-retaining flange;

FIG. 13 is a plan view of a body blank similar to FIGS. 5 and 9 showing that the stave former compresses the body blank between a curved fold line and a curved bottom edge to form a series of thick and thin slanted portions that extend between the curved fold line and the curved bottom edge;

FIG. 14 is an enlarged partial plan view of the body blank of FIG. 13 showing the curved fold line and the series of thick and thin slanted portions formed in the floor-retaining flange and extending diagonally in an alternating sequence;

FIG. 15 is an enlarged partial elevation view of another embodiment of an insulative cup in accordance with the present disclosure showing a region of localized plastic deformation in which a plurality of vertical staves are formed in an inner periphery of the floor-retaining flange so that the vertical staves are hidden when the insulative cup is assembled;

FIG. 16 is an enlarged partial elevation view of another embodiment of an insulative cup in accordance with the present disclosure similar to FIG. 15 and showing a region of localized plastic deformation in which a plurality of diamond-shaped ribs are formed in an inner periphery of the floor-retaining flange so that the diamond-shaped ribs are hidden when the insulative cup is assembled;

FIG. 17 is an enlarged partial elevation view of another embodiment of an insulative cup in accordance with the present disclosure similar to FIGS. 15 and 16 showing a region of localized plastic deformation in which a plurality of vertically-slanting ribs are formed in an inner periphery of the floor-retaining flange so that the vertically-slanting ribs are hidden when the insulative cup is assembled;

FIG. 18 is a partial elevation view of a portion of the floor-retaining flange included in the insulative cup of FIG. 1 showing a plurality of measurement points for determining the dimensional consistency of the plurality of vertical staves formed in the floor-retaining flange; and FIG. 19 is a partial elevation view of the portion of the floor-retaining flange shown in FIG. 18 showing the locations at which height, thickness, width, and depth measurements are taken to determine the dimensional consistency of the plurality of vertical ribs formed in the floor-retaining flange.

DETAILED DESCRIPTION

Figure 1B:
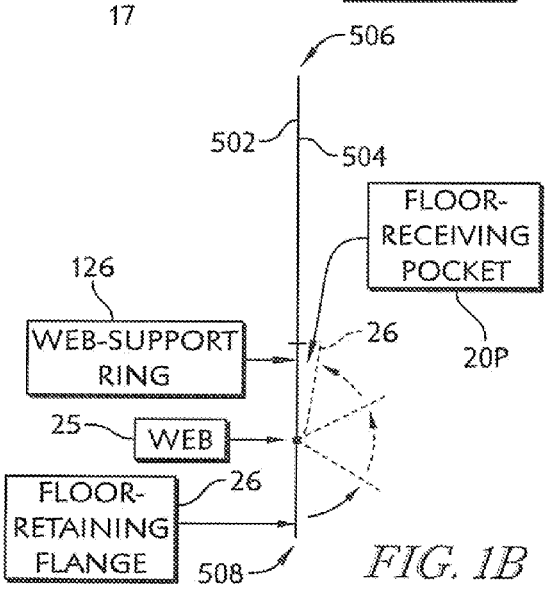
Figure 1C:
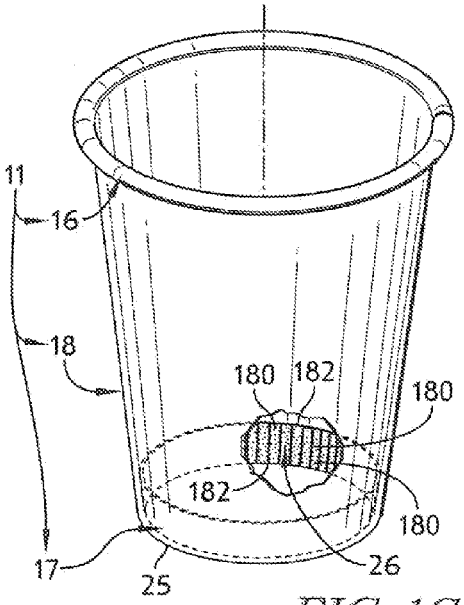

An illustrative body blank 500 shown in FIG. 1A is made of a polymeric material and is folded as suggested in FIG. 1B and wrapped around a central vertical axis (CA) to form a body 11 of a cup as shown, for example, in FIG. 1C. Once folded, a body blank 500 includes a sleeve-shaped side wall 18 and floor mount 17 coupled to a lower portion of the sleeve-shaped side wall 18 and configured to mate with a floor 20 as suggested in FIGS. 2A, 2B, and 3 to form a cup 10. Floor mount 17 is formed in accordance with the present disclosure to have neighboring high-density polymeric portions and relatively low-density polymeric portions cooperate to permit controlled gathering of portions of floor mount 17 as body blank 500 is wrapped around the vertical central axis (CA) during a blank conversion process to form a cup body 11. Floor mount 17 is formed to include an alternating sequence of low-density and high-density vertical staves 180, 182 as shown in the embodiment of FIGS. 1-6, while alternative floor mounts embodiments are shown in FIGS. 7-10 (diamond density pattern), FIGS. 11-14 (diagonal density pattern), and FIGS. 18-19 (other density pattern)

Body blank 500 includes a curved top edge 506 and a curved bottom edge 508 and each edge has the same center of curvature as suggested in FIGS. 1 A and 5 to cause a uniform distance to separate curved top and bottom edges 506, 508 along their length. Body blank 500 also includes a straight right edge 512 interconnecting right ends of top and bottom edges 506, 508 and a straight left edge 514 interconnecting left ends of top and bottom edges 506, 508.

A curved floor-position locator reference line 521 is marked (in phantom) on body blank 500 in FIGS. 1A and 5 to show the relative position of a horizontal platform 21 included in floor 20 (see FIG. 2B) when floor 20 is mated to the body 11 formed using body blank 500 as suggested in FIGS. 2A and 3. Curved floor-position locator reference line 521 has the same center of curvature as curved top and bottom edges 506, 508 as suggested in FIGS. 1A and 5.

Body blank 500 includes a floor mount 17 bounded by curved floor-position locator reference line 521, curved bottom edge 508, and lower portions of straight right and left edges 512, 514 as suggested in FIG. 1A. Body blank 500 also includes a sleeve-shaped side wall 18 provided above floor mount 17 and bounded by curved top edge 506, curved floor-position locator reference line 521, and upper portions of straight right and left edges 512, 514 as suggested in FIG. 1A.

Floor mount 17 of body blank 500 is formed to include a curved fold line 516 located between curved floor-position locator reference line 521 and curved bottom edge 508 as suggested in FIG. 1A. Curved fold line 516 has the same center of curvature as curved floor-position locator reference line 521 and curved bottom edge 508 as suggested in FIGS. 1A and 5.

Floor mount 17 includes a web-support ring 126 coupled to a lower portion of sleeve-shaped side wall 18 at the curved floor-position locator reference line 521 as suggested in FIGS. 1A and 1B. Floor mount 17 also includes a floor-retaining flange 26 provided along curved bottom edge 508 of body blank 500 and a connecting web 25 arranged to extend along curved fold line 516 from left edge 514 to right edge 512 and to interconnect web-support ring 126 and floor-retaining flange 26.

As suggested in FIG. 1B, floor-retaining flange 26 will be folded inwardly and upwardly about curved fold line 516 while body blank 500 is being wrapped around a central vertical axis (CA) during a blank conversion process. This process produces a cup body 11 having an upwardly opening ring-shaped floor-receiving pocket 20P as suggested in FIGS. 1B, 3, and 4. An illustrative floor 20 shown, for example, in FIG. 2B includes a ring-shaped platform-support member 23 that is appended to a perimeter portion of a round horizontal platform 21. Ring-shaped platform-support member 23 is extended downwardly into the companion ring-shaped floor-receiving pocket 20P formed in floor mount 17 to position horizontal platform 21 along the curved floor-position locator reference line 521 so that a cup 10 comprising a body 11 and a floor 20 is formed as shown in FIGS. 1C, 2A, 2B, and 3.

In illustrative embodiments, the arc-shaped floor-retaining flange 26 of floor mount 17 is formed to include along its length an alternating sequence of low-density and high-density staves 180, 182 arranged to lie in side-by-side relation and extend in directions from curved bottom edge 500 toward curved fold line 516 as shown, for example, in FIGS. 1A and 5. As suggested in FIGS. 3 and 4 (and evident in the other drawings), an alternating sequence of relatively narrow, thin, high-density staves 182 and relatively wide, thick, low-density staves 180 is provided in floor-retaining flange 26. Floor-retaining flange 26 is made of a polymeric material that is able to undergo localized plastic deformation in accordance with the present disclosure during the manufacture of body blank 500 to produce such an alternating sequence of high-density and low-density areas. In an illustrative embodiment, floor-retaining flange 26 of body blank 500 is made of an insulative cellular non-aromatic polymeric material.

In illustrative embodiments, the arc-shaped connecting web 25 of floor mount 17 that extends along curved fold line 516 is formed to have a higher density than neighboring portions of the web-support ring 126 and floor-retaining flange 26. Connecting web 25 of floor mount 17 is made of a polymeric material that is able to undergo localized plastic deformation in accordance with the present disclosure during manufacture of body blank 500. In an illustrative embodiment, connecting web 25 of body blank is made of an insulative cellular non-aromatic polymeric material.

Localized plastic deformation is provided in accordance with the present disclosure in, for example, a floor region 104 of a body 11 of an insulative cup 10 comprising an insulative cellular non-aromatic polymeric material as suggested in FIGS. 2A-5. A material has been plastically deformed, for example, when it has changed shape to take on a permanent set in response to exposure to an external compression load and remains in that new shape after the load has been removed. Insulative cup 10 disclosed herein is not a paper cup but rather a cup made of an insulative cellular non-aromatic polymeric material with insulative qualities suitable for holding hot and cold contents.

A blank 500 of polymeric material in accordance with the present disclosure is used to form a cup body 11 as suggested in FIGS. 1A-1C. Then a floor 20 is mated to a floor mount 17 included in the cup body 11 to form a cup 10 as suggested in FIGS. 2A and 2B. The polymeric material is an insulative cellular non-aromatic polymeric material in an illustrative embodiment.

The blank 500 includes an upper band 500U and a lower band 500L as suggested in FIG. 1A. Upper band 500U is formed to include a curved top edge 506. Lower band 500L is formed to include a left-end edge 514, a right-end edge 512, and a curved bottom edge 508 arranged to extend between the left-end and right-end edges 514, 512. Lower band 500L is appended to upper band 500U along a curved fold line 516 to locate the curved fold line 516 between the curved top and bottom edges 506, 508.

The lower band 500L is formed to include a series of high-density staves 182 of a first density and low-density staves 180 of a relatively lower second density as suggested in FIGS. 1A and 6. Each stave is arranged to extend from the curved bottom edge 508 of lower band 500L toward the curved fold line 516. The high-density and low-density staves 182, 180 are arranged to lie in an alternating sequence extending from about the left-end edge of lower band 500L to about the right-end edge of lower band 500L to cause density to alternate from stave to stave along a length of the lower band 500L.

Lower band 500L has a first side 502 and an opposite second side 504 as suggested in FIG. 1B. Each low-density stave 180 has a first face on first side 502 of lower band 500L, a second face on the opposite second side 504 of lower band 500L, and a first thickness defined by a distance between the first and second faces of the low-density stave 180. Each high-density stave 182 has a first face on the first side 502 of lower band 500L, a second face on second side 504 of lower band 500L, and a second thickness defined by a distance between the first and second faces of the high-density stave 182. The second thickness is less than the first thickness. In an illustrative embodiment, the second thickness is about half of the first thickness.

Each high-density stave 182 has a narrow width and each low-density stave 180 has a relatively wider wide width as shown, for example, in FIGS. 2B and 6. The narrow width is about 0.028 inch (0.711 mm) and the relatively wider wide width is about 0.067 inch (1.702 mm). Lower band 500L includes a border section 500B extending from the left-end edge to the right-end edge and lying between the curved fold line 516 and an upper end of each of the high-density and low-density staves 182, 180 as suggested in FIG. 6. Border section 500B has a height of about 0.035 inch (0.889 mm).

A connecting web 25 included in the blank 500 is defined by polymeric material extending along and on either side of the curved fold line 516 as suggested in FIGS. 1A, 3, 5, and 6. The connecting web 25 has a third density that is lower than the first density in an illustrative embodiment. The third density of the connecting web 25 is about equal to the second density of the low-density staves 180.

Each low-density stave 180 has a first thickness. Each high-density stave 182 has a relatively thinner second thickness as suggested in FIG. 4. The connecting web 25 has a third thickness that is about equal to the relatively thinner second thickness.

Upper band 500U includes a left-end edge 514 arranged to extend from the curved fold line 516 to a first end of the curved top edge 506 and a right-end edge 512 arranged to extend from the curved fold line 516 to an opposite second end of the curved top edge 506. Upper band 500U includes a top strip 500U1 arranged to extend along the curved top edge 506 from the left-end edge 514 of upper band 500U to the right-end edge 512 of upper band 500U, a bottom strip 500U3 arranged to extend along curved fold line 516 from the left-end edge 514 of upper band 500U to the right-end edge 512 of upper band 500U, and a middle strip 500U2 arranged to lie between and interconnect the top and bottom strips and extend from the left-end edge 514 of upper band 500U to the right-end edge 512 of upper band 500U.

Top strip 500U1 of upper band 500U is configured to be moved relative to the middle strip 500U2 of upper band 500U during a blank conversion process to form a circular rolled brim 16. Middle strip 500U2 of upper band 500U is configured to be wrapped about a central vertical axis (CA) during the blank conversion process to provide a sleeve-shaped side wall 18 coupled to circular rolled brim 16.

Bottom strip 500U3 of upper band 500U and lower band 500L cooperate to form a floor mount 17 as suggested in FIGS. 1A, 1B, and 3. Floor mount 17 is configured to provide means for receiving a portion 23 of a floor 20 during a cup formation process to cause floor 20 and sleeve-shaped side wall 18 to cooperate to form an interior region 14 in response to folding movement of lower band 500L along the curved fold line 516 while wrapping upper band 500U around a vertical central axis (CA) to establish an annular shape of lower band 500L to provide a ring-shaped floor-retaining flange 26 and to establish an annular shape of the bottom strip 500U3 of upper band 500U to provide a ring-shaped web-support ring 126 surrounding the ring-shaped floor-retaining flange 26 to provide an annular floor-receiving pocket 20P therebetween.

In a first embodiment shown in FIGS. 1A-4, first face 502 of lower band 500L is formed to include a depression along the length of a high-density stave 182 and between opposing edges of neighboring low-density staves 180. The depression is arranged to open in a direction away from the ring-shaped web-support ring 126 defined by the bottom strip 500U3 of upper band 500U and arranged to surround high-density and low-density staves 182, 180 included in the floor-retaining flange 26 defined by lower band 500L.

In another embodiment shown in FIG. 15, first face of lower band 500L is formed to include a depression along the length of a high-density stave 182 and between opposing edges of neighboring low-density staves 180. The depression is arranged to open in a direction toward the ring-shaped web support ring 126 defined by the bottom strip of upper band 500U and arranged to surround high-density and low-density staves 182, 180 included in the floor-retaining flange 26 defined by lower band 500L.

A first embodiment of insulative cup 10 having region 104 where localized plastic deformation provides segments of insulative cup 10 that exhibit higher material density than neighboring segments of insulative cup 10 in accordance with the present disclosure is shown in FIGS. 2A-5. Insulative cup 10 is similar to the insulative cup 10 disclosed in U.S. patent application Ser. No. 13/491,007 and is incorporated by reference in its entirety herein. In the present application, the fourth region 104 of insulative cup 10 of U.S. patent application Ser. No. 13/491,007 is replaced with other floor region embodiments as disclosed herein. As an example, insulative cup 10 is made using an illustrative body blank 500 shown in FIGS. 1A and 5. A suitable cup-manufacturing process that makes body blank 500 and insulative cup 10 is disclosed in U.S. patent application Ser. No. 13/526,444 and is incorporated by reference in its entirety herein.

An insulative cup 10 comprises a body 11 including a sleeve-shaped side wall 18 and a floor 20 coupled to body 11 to define an interior region 14 bound by sleeve-shaped side wall 18 and floor 20 as shown, for example, in FIG. 2A. Body 11 further includes a rolled brim 16 coupled to an upper end of side wall 18 and a floor mount 17 coupled to a lower end of side wall 18 as suggested in FIGS. 2A, 2B, and 3. Floor mount 17 includes a web-support ring 126, a floor-retaining flange 26, and a connecting web 25 as shown, for example, in FIGS. 1A, 1B, and 3.

Body 11 is formed from a strip of insulative cellular non-aromatic polymeric material as disclosed herein. In accordance with the present disclosure, a strip of insulative cellular non-aromatic polymeric material is configured (by application of pressure-with or without application of heat) to provide means for enabling localized plastic deformation in at least one selected region (for example, region 104) of body 11 to provide a plastically deformed first material segment having a first density located in a first portion of the selected region of body 11 and a second material segment having a second density lower than the first density located in an adjacent second portion of the selected region of body 11 without fracturing the insulative cellular non-aromatic polymeric material so that a predetermined insulative characteristic is maintained in body 11.

According to the present disclosure, body 11 includes localized plastic deformation that is enabled by the insulative cellular non-aromatic polymeric material in a floor-retaining flange 26 of a floor mount 17. Floor-retaining flange 26 includes an alternating sequence of upright thick relatively low-density staves 180 and thin relatively high-density staves 182 arranged in side-to-side relation to extend upwardly from a connecting web 25 of floor mount 17 toward interior region 14 bounded by sleeve-shaped side wall 18. This alternating sequence of thick low-density staves 180 and thin high-density staves 182 is preformed in a body blank 500 made of a deformable polymeric material in an illustrative embodiment before body blank 500 is formed to define insulative cup 10 as suggested in FIGS. 2A-5.

Referring now to FIG. 5, body blank 500 is formed to include connecting web 25 of floor mount 17 which is a relatively high-density area of localized plastic deformation that interconnects a relatively low density web-support ring 126 of floor mount 17 to a relatively low density floor-retaining flange 26 of floor mount 12. Referring to FIG. 3, floor mount 17 is configured to include a ring-shaped floor-receiving pocket 20P sized to receive a platform-support member 23 of floor 20 (as also suggested in FIG. 1B) such that floor 20 is supported by the floor mount 17 to cause a horizontal platform 21 of floor 20 to be supported at circular floor-position locator reference line 521 to form a boundary of the interior region 14 of insulative cup 10. Insulative cup 10 forms a vessel having a mouth 32 opening into an interior region 14 that is bounded by sleeve-shaped side wall 18 and horizontal platform 21 of floor 20.

Sleeve-shaped side wall 18 includes an upright inner strip 514, an upright outer strip 512, and an upright funnel-shaped web 513 extending between inner and outer strips 514, 512 as suggested in FIG. 3. Upright inner strip 514 is arranged to extend upwardly from floor 20 and upright outer strip 512 is arranged to extend upwardly from floor 20 to mate with upright inner strip 514 along an interface 184 therebetween to form a seam of sleeve-shaped side wall 18 as suggested in FIGS. 3 and 4. Upright funnel-shaped web 513 is arranged to interconnect upright inner and outer strip 514, 512 and surround interior region 14. Upright funnel-shaped web 513 is configured to cooperate with upright inner and outer strips 514, 512 to form sleeve-shaped side wall 18 as suggested in FIGS. 2 and 3.

Rolled brim 16 is coupled to an upper end of sleeve-shaped side wall 18 to lie in spaced-apart relation to floor 20 and to frame an opening into interior region 14. Rolled brim 16 includes an inner rolled tab 161 (shown in phantom), an outer rolled tab 162, and a C-shaped brim lip 163 as suggested in FIGS. 1 and 2. The inner rolled tab 161 is coupled to an upper end of upright outer strip 512 included in sleeve-shaped side wall 18. Outer rolled tab 162 is coupled to an upper end of upright inner strip 514 included in sleeve-shaped side wall 18 and to an outwardly facing exterior surface of inner rolled tab 161. Brim lip 163 is arranged to interconnect oppositely facing side edges of each of inner and outer rolled tabs 161, 162. Brim lip 163 is configured to cooperate with inner and outer rolled tabs 161, 162 to form rolled brim 16 as suggested in FIGS. 2A and 2B.

Floor mount 17 of body 11 is coupled to a lower end of sleeve-shaped side wall 18 and to floor 20 to support floor 20 in a stationary position relative to sleeve-shaped side wall 18 to form interior region 14 as suggested in FIGS. 2A. 2B and 3. Floor mount 17 includes a floor-retaining flange 26 coupled to floor 20, a web-support ring 126 coupled to the lower end of sleeve-shaped side wall 18 and arranged to surround floor-retaining flange 26, and a connecting web 25 arranged to interconnect floor-retaining flange 26 and web-support ring 126 as suggested in FIG. IB and 3. Connecting web 25 is configured to provide a material segment having, higher first density. Web-support ring 126 is configured to provide a second material segment having lower second density. Each of connecting web 25 and web-support ring 126 has an annular shape. Floor-retaining flange 26 has an annular shape. Each of floor-retaining flange 26, connecting web 25, and web-support ring, 126 includes an inner layer having an interior surface mating with floor 20 and an overlapping outer layer matingg, with an exterior surface of inner layer as suggested in FIGS. 2B and 3.

Floor 20 of insulative cup 10 includes a horizontal platform 21 bounding a portion of interior region 14 and a platform-support member 23 coupled to horizontal platform 21 as shown, for example, in FIGS. 2 and 3. Platform-support member 23 is ring-shaped and arranged to extend downwardly away from horizontal platform 21 and interior region 14 into a floor-receiving pocket 20P provided between floor-retaining flange 26 and the web-support ring 126 surrounding floor-retaining flange 26 to mate with each of floor-retaining flange 26 and web-support ring 126 as suggested in FIGS. 1B, 3, and 7.

Platform-support member 23 of floor 20 has an annular shape and is arranged to surround floor-retaining flange 26 and lie in an annular space provided between horizontal platform 21 and connecting web 25 as suggested in FIG. 3. Each of floor-retaining flange 26, connecting web 25, and web-support ring 126 includes an inner layer having an interior surface mating with floor 20 and an overlapping outer layer mating with an exterior surface of inner layer as suggested in FIG. 3 Inner layer of each of floor-retaining flange 26, web 25, and web-support ring 126 is arranged to mate with platform-support member 23 as suggested in FIG. 3.

Floor-retaining flange 26 of floor mount 17 is arranged to lie in a stationary position relative to sleeve-shaped side wall 18 and coupled to floor 20 to retain floor 20 in a stationary position relative to sleeve-shaped side wall 18 as suggested in FIGS. 2B and 3. Horizontal platform 21 of floor 20 has a perimeter edge mating with the circular floor-position locator reference line 521 provided on an inner surface of sleeve-shaped side wall 18 and an upwardly facing top side bounding a portion of interior region 14 as suggested in FIG. 3.

Floor-retaining flange 26 of floor mount 17 is ring-shaped and includes an alternating sequence of upright thick low-density staves 180 and thin high-density staves 182 arranged to lie in side-to-side relation to one another to extend upwardly toward a downwardly facing underside of horizontal platform 21. A first of the upright thick low-density staves 180 is configured to include a right side edge extending upwardly toward the underside of horizontal platform 21. A second of the upright thick staves 180 is configured to include a left side edge arranged to extend upwardly toward underside of horizontal platform 21 and lie in spaced-apart confronting relation to right side edge of the first of the upright thick staves 180. A first of the upright thin high-density staves 182 is arranged to interconnect left and right side edges and cooperate with left and right side edges to define therebetween a vertical channel opening inwardly into a lower interior region bounded by horizontal platform 21 and floor-retaining flange 26 as suggested in FIGS. 3 and 4. The first of the thin high-density staves 182 is configured to provide the first material segment having the higher first density. The first of the thick low-density staves 180 is configured to provide the second material segment having the lower second density.

Floor-retaining flange 26 of floor mount 17 has an annular shape and is arranged to surround a vertically extending central axis (CA) intercepting a center point of horizontal platform 21 as suggested in FIGS. 3 and 4. The first of the thin high-density staves 182 has an inner wall facing toward a portion of the vertically extending central axis CA passing through the lower interior region. Platform-support member 23 is arranged to surround floor-retaining flange 26 and cooperate with horizontal platform 21 to form a downwardly opening floor chamber 20C containing the alternating series of upright thick low-density staves 180 and thin high-density staves 182 therein.

Each first material segment (e.g. stave 182) in the insulative cellular non-aromatic polymeric material has a relatively thin first thickness. Each companion second material segment (e.g. stave 180) in the insulative cellular non-aromatic polymeric material has a relatively thicker second thickness.

Body 11 is formed from a sheet of insulative cellular non-aromatic polymeric material that includes, for example, a strip of insulative cellular non-aromatic polymeric material and a skin coupled to one side of the strip of insulative cellular non-aromatic polymeric material. In one embodiment of the present disclosure, text and artwork or both can be printed on a film included in the skin. The skin may further comprise an ink layer applied to the film to locate the ink layer between the film and the strip of insulative cellular non-aromatic polymeric material. In another example, the skin and the ink layer are laminated to the strip of insulative cellular non-aromatic polymeric material by an adhesive layer arranged to lie between the ink layer and the insulative cellular non-aromatic polymer material. As an example, the skin may be biaxially oriented polypropylene.

Insulative cellular non-aromatic polymeric material comprises, for example, a polypropylene base resin having a high melt strength, one or both of a polypropylene copolymer and homopolymer resin, and one or more cell-forming agents. As an example, cell- forming agents may include a primary nucleation agent, a secondary nucleation agent, and a blowing agent defined by gas means for expanding the resins and to reduce density. in one example, the gas means comprises carbon dioxide. in another example, the base resin comprises broadly distributed molecular weight polypropylene characterized by a distribution that is unimodal and not bimodal. Further details of a suitable material for use as insulative cellular non-aromatic polymeric material is disclosed, in U.S. patent application Ser. No. 13/491,327, previously incorporated herein by reference.

Insulative cup 10 is an assembly comprising the body blank 500 and the floor 20. As an example, floor 20 is mated with bottom portion 24 during cup-manufacturing process 40 to form a primary seal therebetween. A secondary seal may also be established between support structure 19 and floor 20. An insulative container may be formed with only the primary seal, only the secondary seal, or both the primary and secondary seals.

Referring again to FIG. 2A, a top portion of side wall 18 is arranged to extend in a downward direction 28 toward floor 20 and is coupled to bottom portion 24. Bottom portion 24 is arranged to extend in an opposite upward direction 30 toward rolled brim 16. Top strip 500U1 of upper band 500U is curled during cup-manufacturing process 40 to form rolled brim 16. Rolled brim 16 forms a mouth 32 that is arranged to open into interior region 14 of cup 10.

Side wall 18 is formed using a body blank 500 as suggested in FIGS. 5 and 6. Body blank 500 may be produced from a strip of insulative cellular non-aromatic polymeric material, a laminated sheet, or a strip of insulative cellular non-aromatic polymeric material that has been printed on. Referring now to FIGS. 5 and 6, body blank 500 is generally planar with a first side 502 and a second side 504. Body blank 500 is embodied as a circular ring sector with an outer arc length $S_1$ that defines a first edge 506 and an inner arc length $S_2$ that defines a second edge 508. The arc length $S_1$ is defined by a subtended angle $\Theta$ in radians times the radius $R_1$ from an axis 510 to the edge 506. Similarly, inner arc length $S_2$ has a length defined as subtended angle $\Theta$ in radians times the radius $R_2$. The difference of $R_1$-$R_2$ is a length h which is the length of two linear edges 512 and 514. Changes in $R_1$, $R_2$ and $\Theta$ will result in changes in the size of insulative cup 10. First linear edge 512 and second linear edge 514 each lie on a respective ray emanating from center 510. Thus, body blank 500 has two planar sides, 502 and 504, as well as four edges 506, 508, 512, and 514 which define the boundaries of body blank 500.

Fold line 516 has a radius R3 measured between center 510 and a fold line 516 and fold line 516 has a length $S_3$. As shown in FIG. 5, $R_1$ is relatively greater than $R_3$. $R_3$ is relatively greater than $R_2$. The differences between $R_1$, $R_2$, and $R_3$ may vary depending on the application.

Fold line 516 shown in FIG. 5 is a selected region of a strip of insulative cellular non-aromatic polymeric material that has been plastically deformed in accordance with the present disclosure (by application of pressure—with or without application of heat) to induce a permanent set resulting in a localized area of increased density and reduced thickness. The thickness of the insulative cellular non-aromatic polymeric material at fold line 516 is reduced by about 50%. In addition, the blank 500 is formed to include a number of depressions 518 or ribs 518 positioned between the curved bottom edge 508 and curved fold line 516 with the depressions 518 creating a discontinuity in a surface 531. Each depression 518 is linear having a longitudinal axis that overlies a ray emanating from center 510. As discussed above, depressions 518 promote orderly forming of floor-retaining flange 26. The insulative cellular non-aromatic polymer material of reduced thickness at fold line 516 ultimately serves as connecting web 25 in the illustrative insulative cup 10. As noted above, connecting web 25 promotes folding of floor-retaining flange 26 inwardly toward interior region 14. Due to the nature of the insulative cellular non-aromatic polymeric material used to produce illustrative body blank 500, the reduction of thickness in the material at curved fold line 516 and depressions 518 owing to the application of pressure—with or without application of heat—increases the density of the insulative cellular non-aromatic polymeric material at the localized reduction in thickness.

As shown in FIG. 6, each depression 518 formed in floor-retaining flange 26 is spaced apart from each neighboring depression 518 by a first distance 551. In an illustrative example, first distance 551 is about 0.067 inches (1.7018 mm). Each depression 518 is also configured to have a first width 552. In an illustrative example, first width 552 is about 0.028 inches (0.7112 mm). Each depression 518 is also spaced apart from curved fold line 516 by a second distance 553. In an illustrative example, second distance 553 is about 0.035 inches (0.889 mm).

Depressions 518 and curved fold line 516 are formed by a die that cuts body blank 500 from a strip of insulative cellular non-aromatic polymeric material, laminated sheet, or a strip of printed-insulative cellular non-aromatic polymeric material and is formed to include punches or protrusions that reduce the thickness of the body blank 500 in particular locations during the cutting process. The cutting and reduction steps could be performed separately, performed simultaneously, or that multiple steps may be used to form the material. For example, in a progressive process, a first punch or protrusion could be used to reduce the thickness a first amount by applying a first pressure load. A second punch or protrusion could then be applied with a second pressure load greater than the first. In the alternative, the first punch or protrusion could be applied at the second pressure load. Any number of punches or protrusions may be applied at varying pressure loads, depending on the application.

As shown in FIGS. 1A-4, depressions 518 formed in floor-retaining flange 26 permit controlled gathering of the floor-retaining flange 26 that supports a platform-support member 23 and horizontal platform 21. Floor-retaining flange 26 bends about curved fold line 516 to form floor-receiving pocket 20P with curved fold line 516 being configured to form connecting web 25. The absence of material in depressions 518 provides relief for the insulative cellular non-aromatic polymeric material as it is formed into floor-retaining flange 26. This controlled gathering can be contrasted to the bunching of material that occurs when materials that have no relief are formed into a structure having a narrower dimension. For example, in traditional paper cups, a retaining flange type will have a discontinuous surface due to uncontrolled gathering. Such a surface is usually worked in a secondary operation to provide an acceptable visual surface, or the uncontrolled gathering is left without further processing, with an inferior appearance. The approach of forming the depressions 518 in accordance with the present disclosure is an advantage of the insulative cellular non-aromatic polymeric material of the present disclosure in that the insulative cellular non-aromatic polymeric material is susceptible to plastic deformation in localized zones in response to application of pressure (with or without application of heat) to achieve a superior visual appearance.

In another embodiment shown in FIGS. 7-10, an insulative cup 310 is similar to insulative cup 10; however, the floor-retaining flange 26 of floor mount-17 of insulative cup 10 is omitted and replaced with a floor-retaining flange 326 of floor mount 317 that includes a pattern of areas of thicker and thinner areas that form a crossing pattern as suggested in FIGS. 7, 9, and 10. Elements of insulative cup 310 that are similar to insulative cup 10 have like reference designators and the elements that are structurally different are given a new reference designator.

Insulative cup 310 is formed from a body blank 600 shown in FIGS. 9 and 10. Body blank 600 is similar to body blank 500, with the principal difference being that the staves 180 and 182 are replaced with knurling 360. The geometry of body blank 600 will not be discussed in detail here, except where the structure of body blank 600 differs from body blank 500. For example, floor-retaining flange 326 includes first high-density areas of reduced thickness 382 which are positioned at an angle 386 of about 45 degrees as compared to second edge 508 as suggested in FIGS. 7 and 10. Second high-density areas of reduced thickness 383 formed in floor-retaining flange 326 are oriented perpendicular to the first high-density areas of reduced thickness 382 and intersect the high-density first areas of reduced thickness 382 at intersections 384. The reduced high-density areas of thickness 382 and 383 are interposed between unreduced low-density areas 380 which may include areas bounded by reduced areas of thickness 382 and 383 and/or a fold line 516 formed in a blank 600.

Knurling 360 which is a result of the formation of reduced areas of thickness 382 and 383 also permits controlled gathering of floor-retaining flange 326 similar to the staves 180 and 182 of insulative cup 10. For example, reduced areas of thickness 382 and 383 provide relief when the blank 600 is wrapped about the central axis CA so that the surface of floor-retaining flange 326 appears neat and regular when insulative cup 310 is formed.

Angle 386 may be varied from zero to ninety degrees depending on various factors. Likewise, the second areas of reduced thickness 383 may intersect the first areas of reduced thickness 383 at any of a number of angles when the knurling 360 is formed. Furthermore, the distance between adjacent areas of reduced thickness 382 may be greater than or less than the distance between adjacent areas of reduced thickness 383 such that the pattern may be varied.

In yet another embodiment shown in FIGS. 11-14, an insulative cup 410 is similar to insulative cup 10; however, the floor-retaining flange 26 of floor mount-17 of insulative cup 10 is omitted and replaced with a floor-retaining flange 426 of floor mount 417 that includes a diagonal pattern formed at an angle as suggested in FIGS. 11, 13, and 14. Elements of insulative cup 410 that are similar to insulative cup 10 have like reference designators and the elements that are structurally different are given a new reference designator.

Insulative cup 410 is formed from a body blank 700 as shown in FIGS. 13 and 14. Body blank 600 is similar to body blank 500, with the principal difference being that the staves 180 and 182 are replaced with staves 480 and 482. The geometry of body blank 700 will not be discussed in detail here, except where the structure of body blank 700 differs from body blank 500. For example, floor-retaining flange 426 includes high-density first staves of reduced thickness 482 which are positioned at an angle 486 of about 45 degrees as compared to second edge 508 as suggested in FIGS. 11 and 14. Second low-density staves 482 are interposed between first high-density staves 480.

Staves 480 and 482 facilitate orderly gathering of floor-retaining flange 426 similar to the staves 180 and 182 of insulative cup 10. For example, high-density staves 480 have reduced areas of thickness that provide relief when body blank 700 is wrapped about the central axis CA so that the surface of floor-retaining flange 426 appears neat and regular when insulative cup 410 is formed. Angle 486 may be varied degrees depending on various factors. Furthermore, the distance between adjacent staves 382 may be varied.

The foregoing discloses various patterns that may be formed in the floor region 104 of the insulative cups 10, 310, and 410 with the patterns oriented toward the floor chamber 20C of insulative cups 10, 310, and 410. As suggested in FIGS. 15-17, the patterns formed in floor-retaining flanges 26, 326, and 426 may be formed on the opposite side of the respective body blanks 500, 600, and 700 so that the patterns are juxtaposed against platform-support member 13 of floor 20.

For example, insulative cup 10' comprises a floor-retaining flange 26' includes staves 180' and 182' which are not visible from the inner floor chamber 20C as suggested in FIG. 15. Staves 180' and 182' still permit controlled gathering of the floor-retaining flange 26' when it is wrapped about the platform-support member 23 and the insulative cup 10' is formed, but the expanded material is hidden from view and an inner surface of floor-retaining flange 26' visible from the inner floor chamber 20C is relatively smooth because of the relief provided by the staves 180' and 182'.

Similarly, an insulative cup 310' is formed such that knurling 360' is in contact with the platform-support member 23 and not visible from the inner floor chamber 20C as suggested in FIG. 16. A floor-retaining flange 326' includes first areas of reduced thickness 382' and second areas of reduced thickness 383' that intersect at intersections 384' leaving areas 380' of normal thickness. Knurling 360' still permits controlled gathering of the floor-retaining flange 326' when it is wrapped about the platform-support member 23 and the insulative cup 310' is formed, but the expanded material is hidden from view and an inner surface of floor-retaining flange 326' visible from the inner floor chamber 20C is relatively smooth because of the relief provided by the first areas of reduced thickness 382' and second areas of reduced thickness 383'.

Still another insulative cup 410' is formed such that a floor-retaining flange 426' includes first staves 480' and second staves 482' in contact with the platform-support member 13 and not visible from the inner floor chamber 20C as suggested in FIG. 17. The second staves 482' are areas of reduced thickness and the first staves 480' have a larger thickness than the second staves 482'. The staves 480' and 482' are formed at an angle relative to the lower edge of insulative cup 410'. The relief provided by second staves 482' permits controlled gathering of the floor-retaining flange 426' when it is wrapped about the platform-support member 23 and the insulative cup 410' is formed, but the expanded material is hidden from view and an inner surface of floor-retaining flange 426' visible from the inner floor chamber 20C is relatively smooth.

The deformation achieved in the blanks is dependent on several factors. As illustrated in FIGS. 18 and 19, the deformation of the insulative cellular non-aromatic polymeric material may result in some irregularity of the material in cross-section. For example, FIG. 18 is a partial elevation view of a portion of the floor-retaining flange included in the insulative cup of FIG. 2A showing a plurality of measurement points for determining the dimensional consistency of the plurality of vertical ribs formed in the floor-retaining flange. In general, the dimensional consistency is maintained at each measurement point. However, as shown in FIG. 19, there may be some variation of the thickness in some embodiments.

The partial elevation view of the portion of the floor-retaining flange shown in FIG. 19 shows the locations at which height 186, thickness 188, width 190, and depth 192 measurements are taken to determine the dimensional consistency of the plurality of staves 180 and 182 formed in the floor-retaining flange. In the illustrative embodiment of FIG. 19, stave 180 has a height 186 that is approximately equal to the thickness of a sheet used to form the body blank 500. Depth 192 of stave 180 is maximized in a central location and is gradually reduced to stave 182 which has a thickness 188. The width of each combination of staves 180 and 182 is maintained consistently at 190. Thus, while the stave 180 has some lateral variation in depth, the thickness 188 and height 186 are maintained along the length of each stave 180.

The invention claimed is:

1. A blank of polymeric material used to form a body of a cup, the blank comprising an upper band formed to include a curved top edge and a lower band formed to include a left-end edge, a right-end edge, and a curved bottom edge arranged to extend between the left-end and right-end edges, wherein the lower band is appended to the upper band along a curved fold line to locate the curved fold line between the curved top and bottom edges, the lower band is formed to include a series of high-density staves of a first density and low-density staves of a relatively lower second density, each stave is arranged to extend from the curved bottom edge of the lower band toward the curved fold line, and the high-density and low-density staves are arranged to lie in an alternating sequence extending from about the left-end edge of the lower band to the right-end edge of the lower band to cause density to alternate from stave to stave along a length of the lower band, wherein the lower band has a first side and an opposite second side, each low-density stave has a first face on the first side of the lower band, a second face on the opposite second side of the lower band, and a first thickness defined by a distance between the first and second faces of the low-density stave, and each high-density stave has a first face on the first side of the lower band, a second face on the second side of the lower band, and a second thickness defined by a distance between the first and second faces of the high-density stave, and the second thickness is less than the first thickness, wherein the second thickness is about half of the first thickness.

2. The blank of claim 1, wherein the polymeric material is an insulative cellular non-aromatic polymeric material.

3. The blank of claim 1, wherein a connecting web is defined by polymeric material extending along and on either side of the curved fold line and the connecting web has a third density that is lower than the first density.

4. The blank of claim 3, wherein the third density of the connecting web is about equal to the second density of the low-density staves.

5. The blank of claim 4, wherein each low-density stave has a first thickness, each high-density stave has a relatively thinner second thickness, and the connecting web has a third thickness that is about equal to the relatively thinner second thickness.

6. The blank of claim 3, wherein the polymeric material is an insulative cellular non-aromatic polymeric material.

7. The blank of claim 1, wherein the upper band includes a left-end edge arranged to extend from the curved fold line to a first end of the curved top edge and a right-end edge arranged to extend from the curved fold line to an opposite second end of the curved top edge, the upper band includes a top strip arranged to extend along the curved top edge from the left-end edge of the upper band to the right-end edge of the upper band, a bottom strip arranged to extend along the curved fold line from the left-end edge of the upper band to the right-end edge of the upper band, and a middle strip arranged to lie between and interconnect the top and bottom strips and extend from the left-end edge of the upper band to the right-end edge of the upper band, the top strip is configured to be moved relative to the middle strip during a blank conversion process to form a circular rolled brim, the middle strip is configured to be wrapped about a central vertical axis during the blank conversion process to provide a sleeve-shaped side wall coupled to the circular rolled brim, and the bottom strip of the upper band and the lower band cooperate to form a floor mount configured to provide means for receiving a portion of a floor during a cup formation process to cause the floor and the sleeve-shaped side wall to cooperate to form an interior region in response to folding movement of the lower band along the curved fold line while wrapping the upper band around a vertical central axis to establish an annular shape of the lower band to provide a ring-shaped floor-retaining flange and to establish an annular shape of the bottom strip of the upper band to provide a ring-shaped web-support ring surrounding the ring-shaped floor-retaining flange to provide an annular floor-receiving pocket therebetween.

8. The blank of claim 7, wherein a connecting web is defined by polymeric material extending along and on either side of the curved fold line and the connecting web has a third density that is lower than the first density and wherein the connecting web is appended to the web-support ring and to the floor-retaining flange.

9. The blank of claim 8, wherein the polymeric material is an insulative cellular non-aromatic polymeric material.

10. A blank of polymeric material used to form a body of a cup, the blank comprising an upper band formed to include a curved top edge and a lower band formed to include a left-end edge, a right-end edge, and a curved bottom edge arranged to extend between the left-end and right-end edges, wherein the lower band is appended to the upper band along a curved fold line to locate the curved fold line between the curved top and bottom edges, the lower band is formed to include a series of high-density staves of a first density and low-density staves of a relatively lower second density, each stave is arranged to extend from the curved bottom edge of the lower band toward the curved fold line, and the high-density and low-density staves are arranged to lie in an alternating sequence extending from about the left-end edge of the lower band to the right-end edge of the lower band to cause density to alternate from stave to stave along a length of the lower band, wherein each high-density stave has a narrow width and each low-density stave has a relatively wider wide width, wherein the narrow width is about 0.028 inch (0.711 mm) and the relatively wider wide width is about 0.067 inch (1.702 mm).

11. The blank of claim 10, wherein the polymeric material is an insulative cellular non-aromatic polymeric material.

12. A blank of polymeric material used to form a body of a cup, the blank comprising an upper band formed to include a curved top edge and a lower band formed to include a left-end edge, a right-end edge, and a curved bottom edge arranged to extend between the left-end and right-end edges, wherein the lower band is appended to the upper band along a curved fold line to locate the curved fold line between the curved top and bottom edges, the lower band is formed to include a series of high-density staves of a first density and low-density staves of a relatively lower second density, each stave is arranged to extend from the curved bottom edge of the lower band toward the curved fold line, and the high-density and low-density staves are arranged to lie in an alternating sequence extending from about the left-end edge of the lower band to the right-end edge of the lower band to cause density to alternate from stave to stave along a length of the lower band, wherein the lower band includes a border section extending from the left-end edge to the right-end edge and lying between the curved fold line and an upper end of each of the high-density and low-density staves and the border section has a height of about 0.035 inch (0.889 mm).

13. A blank of polymeric material used to form a body of a cup, the blank comprising an upper band formed to include a curved top edge and a lower band formed to include a left-end edge, a right-end edge, and a curved bottom edge arranged to extend between the left-end and right-end edges, wherein the lower band is appended to the upper band along a curved fold line to locate the curved fold line between the curved top and bottom edges, the lower band is formed to include a series of high-density staves of a first density and low-density staves of a relatively lower second density, each stave is arranged to extend from the curved bottom edge of the lower band toward the curved fold line, and the high-density and low-density staves are arranged to lie in an alternating sequence extending from about the left-end edge of the lower band to the right-end edge of the lower band to cause density to alternate from stave to stave along a length of the lower band, wherein the lower band has a first side and an opposite second side, each low-density stave has a first face on the first side of the lower band, a second face on the opposite second side of the lower band, and a first thickness defined by a distance between the first and second faces of the low-density stave, and each high-density stave has a first face on the first side of the lower band, a second face on the second side of the lower band, and a second thickness defined by a distance between the first and second faces of the high-density stave, wherein the first face is formed to include a depression along the length of a high-density stave and between opposing edges of neighboring low-density staves and the depression is arranged to open in a direction away from the ring-shaped web support ring defined by the bottom strip of the upper band and arranged to surround high-density and low-density staves included in the floor-retaining flange defined by the lower band.

14. The blank of claim 13, wherein the polymeric material is an insulative cellular non-aromatic polymeric material.

15. A blank of polymeric material used to form a body of a cup, the blank comprising an upper band formed to include a curved top edge and a lower band formed to include a left-end edge, a right-end edge, and a curved bottom edge arranged to extend between the left-end and right-end edges, wherein the lower band is appended to the upper band along a curved fold line to locate the curved fold line between the curved top and bottom edges, the lower band is formed to include a series of high-density staves of a first density and low-density staves of a relatively lower second density, each stave is arranged to extend from the curved bottom edge of the lower band toward the curved fold line, and the high-density and low-density staves are arranged to lie in an alternating sequence extending from about the left-end edge of the lower band to the right-end edge of the lower band to cause density to alternate from stave to stave along a length of the lower band, wherein the lower band has a first side and an opposite second side, each low-density stave has a first face on the first side of the lower band, a second face on the opposite second side of the lower band, and a first thickness defined by a distance between the first and second faces of the low-density stave, and each high-density stave has a first face on the first side of the lower band, a second face on the second side of the lower band, and a second thickness defined by a distance between the first and second faces of the high-density stave, wherein the first face is formed to include a depression along the length of a high-density stave and between opposing edges of neighboring low-density staves and the depression is arranged to open in a direction toward the ring-shaped web support ring defined by the bottom strip of the upper band and arranged to surround high-density and low-density staves included in the floor-retaining flange defined by the lower band.

16. The blank of claim 15, wherein the polymeric material is an insulative cellular non-aromatic polymeric material.

* * * * *